US012228357B2

(12) United States Patent
Bombaugh, Jr. et al.

(10) Patent No.: US 12,228,357 B2
(45) **Date of Patent: *Feb. 18, 2025**

(54) SYSTEMS AND METHODS TO MAKE SAFE A HANDGUN

(71) Applicant: Bombach Solutions LLC, Tampa, FL (US)

(72) Inventors: Keith D. Bombaugh, Jr., Tampa, FL (US); Benjamin R. Pauza, Champaign, IL (US)

(73) Assignee: Bombach Solutions LLC, Dunedin, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/223,253

(22) Filed: Jul. 18, 2023

(65) Prior Publication Data

US 2023/0366647 A1 Nov. 16, 2023

Related U.S. Application Data

(63) Continuation of application No. 17/570,995, filed on Jan. 7, 2022, now Pat. No. 11,768,046.

(60) Provisional application No. 63/135,707, filed on Jan. 10, 2021.

(51) Int. Cl.
*F41A 17/06* (2006.01)
*F41A 17/02* (2006.01)

(52) U.S. Cl.
CPC ..... *F41A 17/06* (2013.01); *F41A 17/02* (2013.01); *F41A 17/063* (2013.01); *F41A 17/066* (2013.01)

(58) Field of Classification Search
CPC ..... F41A 17/06; F41A 17/063; F41A 17/066; F41A 17/02
See application file for complete search history.

(56) References Cited

U.S. PATENT DOCUMENTS 4,987,693 A * 1/1991 Brooks ..... F41A 17/04 42/70.11
6,408,905 B1 * 6/2002 Lee ..... F41A 7/08 42/70.11
6,415,542 B1 * 7/2002 Bates ..... F41A 17/06 42/70.11
6,474,011 B1 * 11/2002 Sato ..... F41A 17/36 42/70.11

(Continued)

FOREIGN PATENT DOCUMENTS

WO WO2014/130625 8/2014

*Primary Examiner* — Joshua E Freeman
(74) *Attorney, Agent, or Firm* — Mills IP Law, PLLC

(57) ABSTRACT

Systems and methods are provided for the making safe of a handgun. A safety system includes a lock mechanism coupled to an engagement member and a user interface. The engagement member is movably coupled to the handgun and includes a contact face that is in contact with the slide of the handgun. The engagement member transfers a portion of a force to the slide and moves between a lock position and an unlock position. The lock position corresponds to a separation distance between a distal end of a primer actuator of the handgun and a primer activation plane. The engagement member is configured to transition between the lock position and the unlock position while remaining movably coupled to the handgun. Movement of the engagement member from the lock position is restricted by the lock mechanism until disengaged via the user interface.

20 Claims, 16 Drawing Sheets

(56) References Cited

U.S. PATENT DOCUMENTS 6,591,532 B1 7/2003 Gilbertson et al.
7,827,720 B1 11/2010 Erdem
8,037,632 B2 10/2011 Pikielny
8,046,948 B2 11/2011 Mauch et al.
8,418,391 B2 4/2013 Kemmerer et al.
8,881,443 B2 11/2014 Westwood et al.
9,459,064 B1 * 10/2016 Xu ..... F41A 17/54
9,746,266 B1 8/2017 Barido et al.
9,784,516 B2 10/2017 Murphy, II et al.
9,857,133 B1 1/2018 Kloepfer et al.
10,139,178 B2 11/2018 Lyren et al.
10,190,837 B1 1/2019 Vafadar
10,571,209 B1 2/2020 Dagan
10,591,237 B1 * 3/2020 Cannon ..... F41A 17/066
10,914,543 B2 * 2/2021 Dulude ..... F41A 9/65
10,982,919 B2 4/2021 Dagan
11,085,722 B2 8/2021 Aaronson
11,168,952 B2 * 11/2021 Palkow ..... F41A 21/30
11,514,735 B2 11/2022 Kloepfer et al.
11,768,046 B2 * 9/2023 Bombaugh, Jr. ..... F41A 17/06 42/70.11
2002/0069570 A1 * 6/2002 Lee ..... F41A 7/08 42/70.11
2008/0134556 A1 6/2008 Remelin
2011/0056108 A1 3/2011 McCord et al.
2012/0291327 A1 11/2012 Boutot, Jr.
2013/0019510 A1 1/2013 Kemmerer et al.
2014/0259841 A1 * 9/2014 Carlson ..... F41A 17/08 42/70.11
2014/0366422 A1 * 12/2014 Henry ..... F41A 17/06 42/70.11
2016/0165192 A1 * 6/2016 Saatchi ..... H04N 7/185 386/227
2016/0320154 A1 * 11/2016 Krieger ..... F41A 17/64
2016/0327356 A1 * 11/2016 Milde, Jr. ..... F41A 17/066
2016/0341506 A1 * 11/2016 Steele ..... F41A 17/46
2017/0010062 A1 * 1/2017 Black ..... F41J 5/10
2018/0164060 A1 * 6/2018 Alok ..... F41A 17/063
2018/0224231 A1 * 8/2018 Weinberg ..... F41A 17/38
2018/0238649 A1 * 8/2018 Winiecki ..... H02J 7/00
2018/0259280 A1 * 9/2018 Martin ..... F41A 17/066
2019/0086169 A1 * 3/2019 Hopkins ..... F41A 3/68
2019/0162493 A1 * 5/2019 Hopkins ..... F41A 3/42
2019/0285373 A1 * 9/2019 Palkow ..... F41A 19/16
2019/0376756 A1 * 12/2019 Nieh ..... F41A 17/08
2020/0025509 A1 * 1/2020 Pickerill ..... F41A 17/063
2021/0055069 A1 * 2/2021 Nieh ..... F41A 17/063
2021/0080208 A1 * 3/2021 Wu ..... G08B 25/014
2022/0178639 A1 * 6/2022 Song ..... F41A 17/06
2022/0307786 A1 9/2022 Kloepfer et al.
2022/0307789 A1 * 9/2022 Kloepfer ..... F41A 17/066
2022/0349665 A1 11/2022 Owens et al.
2022/0373284 A1 11/2022 Thiesen et al.
2023/0010591 A1 * 1/2023 Malichen-Snyder ... F41A 17/54
2023/0010645 A1 1/2023 Kloepfer et al.
2023/0014931 A1 1/2023 Kelley et al.
2023/0113679 A1 11/2023 Kloepfer et al.

* cited by examiner

SYSTEMS AND METHODS TO MAKE SAFE A HANDGUN

CROSS-REFERENCE TO RELATED APPLICATIONS

This application is a continuation of U.S. patent application Ser. No. 17/570,995, filed Jan. 7, 2022, and entitled Systems and Methods to Make Safe a Handgun, which claims priority to and the benefit of U.S. Provisional Patent Application No. 63/135,707, filed Jan. 10, 2021, and entitled "Bombach External Firearm Safety," the disclosures of which are incorporated herein by reference in their entirety.

BACKGROUND

The embodiments described herein relate to firearms, and more specifically to handguns. More particularly, the embodiments described herein relate to systems and methods for securing a handgun.

In order to prevent the unauthorized or accidental discharge of a firearm, the firearm is typically made safe. Safing the firearm establishes the firearm in a safe condition, versus a state of readiness. To make the firearm safe, the firearm may be equipped with a lock and/or secured within a locking container.

A general approach to safing a firearm is to secure a fully functional firearm in a secure container, such as a safe or a lockbox. To access and employ the firearm, an authorized user must typically unlock the secure container via a combination, a mechanical key, a magnetic key, an electronic key, a biometric identifier, and/or other similar means. While this approach is generally an effective way to secure a fully functional firearm, the secure container is often placed in a single, fixed location. Such a location may not coincide with a desired deployment location of the firearm. Thus, the location may limit access to the firearm in an exigent situation. Additionally, the amount of time required to open the secure container (e.g., via the entry of the code or the locating and employment of the key) may be significantly greater than desired during an emergency. Therefore, it may be desirable to employ systems and methods that facilitate the securing of a firearm in such a manner that the fully-functional firearm is readily accessible.

Another approach to making a firearm safe is to secure a locking apparatus to, or about the firearm. Such an apparatus is generally configured to prevent an operation of a mechanism of the firearm. For example, various known trigger locks surround the trigger and/or trigger guard of the firearm to prevent access thereto, while additional trigger guards may interfere with the actuation of the trigger and/or the firing mechanism of the firearm. Similarly, barrel locks, cable locks, or other similar devices may obstruct the chamber of the firearm. This prevents the unauthorized or accidental discharge of the firearm by precluding the insertion of a cartridge (e.g., a live round). However, such systems must generally be unlocked and completely removed from the firearm prior to transitioning the firearm to a fully-functional state. As a result, the amount of time required to unlock the apparatus and transition the firearm to a fully-functional state may be unacceptable for a given deployment scenario. Therefore, a need exists for systems and methods that facilitate the securing of the firearm while allowing the fully-functional firearm to be employed within a requisite timeframe.

An additional approach to safing a firearm is to employ a user verification system to correlate an actuation of the firing mechanism to an authorized user prior to each shot of the firearm. Generally, these approaches operatively disengage the trigger from the firing mechanism of the firearm unless it is confirmed that the operation (e.g., the trigger squeeze) is being executed by an authorized user. The verification is typically accomplished via biometric, radio-frequency identification, or other similar electronic systems for each actuation (e.g., pull) of the trigger. In the event of the actuation of the trigger by an unauthorized user, the firearm typically remains in a default, non-operable state. However, the default to a non-operable state may also result in an authorized user being unable to employ the firearm following a malfunction of the verification system. As such, it may be desirable to employ systems and methods for securing the firearm that facilitate the reliable employment of the firearm when accessed by an authorized user.

Thus, a need exists for new and improved systems and methods for securing a firearm.

SUMMARY

This summary introduces certain aspects of the embodiments described herein to provide a basic understanding. This summary is not an extensive overview of the inventive subject matter, and it is not intended to identify key or critical elements or to delineate the scope of the inventive subject matter.

In some embodiments, the present disclosure is directed to a safety system for a handgun. The handgun has a slide movably coupled to the frame. The safety system includes an engagement member movably coupled to the handgun. The engagement member includes an actuator portion configured to receive a motive force. The engagement member also includes a contact face in contact with a portion of the slide so as to transfer a portion of the motive force to the slide in a proximal direction. The engagement member is configured to move relative to the frame between a lock position and an unlock position. The lock position corresponds to a separation distance between a distal end of a primer actuator of the handgun and a primer activation plane of the handgun. The unlock position corresponds to a nominal position of the distal end of the primer actuator. The engagement member is configured to transition between the lock position and the unlock position while remaining movably coupled to the handgun. The safety system also includes a lock mechanism operably coupled to the engagement member and positioned to restrict a movement of the engagement member from the lock position while the lock mechanism is in an engaged state. Additionally, the safety system includes a user interface operably coupled to the lock mechanism and configured to transition the lock mechanism between the engaged state and a disengaged state.

In some embodiments, the safety system also includes a motive assembly operably coupled to the actuator portion, the motive assembly is configured to generate the motive force in response to a user input. In some embodiments, the motive assembly includes an energy storage member, a motor electrically coupled to the energy storage member, and a lead screw rotatable by the motor. The lead screw converts a rotational input from the motor into a linear motion of the engagement member. However, in some embodiments, the motive assembly includes a replaceable gas container containing a gas. In addition to generating the motive force, in some embodiments, the motive assembly is configured as the lock mechanism.

In some embodiments, the lock position further corresponds to a fully-retracted position of the slide, the transition to the lock position ejecting a cartridge from a chamber of a barrel of the handgun.

In some embodiments, the safety system also includes a housing supporting the user interface. The housing includes a coupling portion oriented to receive a mounting structure of the handgun. The housing also includes a lock cavity defined by an inner face of the housing, the lock cavity supporting at least a portion of the lock mechanism. Additionally, the housing includes an interface orifice oriented to facilitate the operable coupling of the engagement member to the lock mechanism. In some embodiments, the safety system also includes at least one fastener positioned adjacent the coupling portion and oriented to secure the mounting structure of the handgun within the coupling portion. The fastener(s) is at least partially occluded by the engagement member when in the lock position, thereby precluding a loosening of the at least one fastener.

In some embodiments, the lock mechanism is positioned within a cavity defined at least partially by the frame of the handgun. In such an embodiment, the engagement member is positioned at least partially between the slide and the frame and oriented to engage a bottom face of the slide. The engagement member is a toothed wheel positioned to engage a toothed portion of the slide.

In some embodiments, the user interface includes at least one of a fingerprint reader, a radio frequency identification reader, a numerical input apparatus, a microphone, a magnetic key, or a mechanical key. Additionally, in some embodiments, the engagement member defines an opening that is aligned with a distal end of a barrel of the handgun. The opening facilitates the departure of a projectile from the distal end of the barrel.

In an additional aspect, the present disclosure is directed to a method to make safe a handgun. The handgun has a slide movably coupled to a frame. The method includes applying a motive force in a proximal direction to an engagement member of a safety system. The engagement member is movably coupled to the handgun. The method also includes transferring at least a portion of the motive force to the slide via a contact face of the engagement member in contact with the slide to develop a proximal movement of the slide. Additionally, the method includes establishing a separation distance between a distal end of a primer actuator of the handgun and a primer activation plane of the handgun. The separation distance precludes contact between the primer actuator and a cartridge primer in response to an actuation of a firing mechanism of the handgun. The separation distance corresponds to a lock position of the engagement member. The method also includes, fixing the engagement member at the lock position via a lock mechanism of the safety system operably coupled to the engagement member. Further, the method includes maintaining the separation distance by precluding a distal movement of the slide via the engagement member positioned at the lock position.

DETAILED DESCRIPTION

Figure 1:
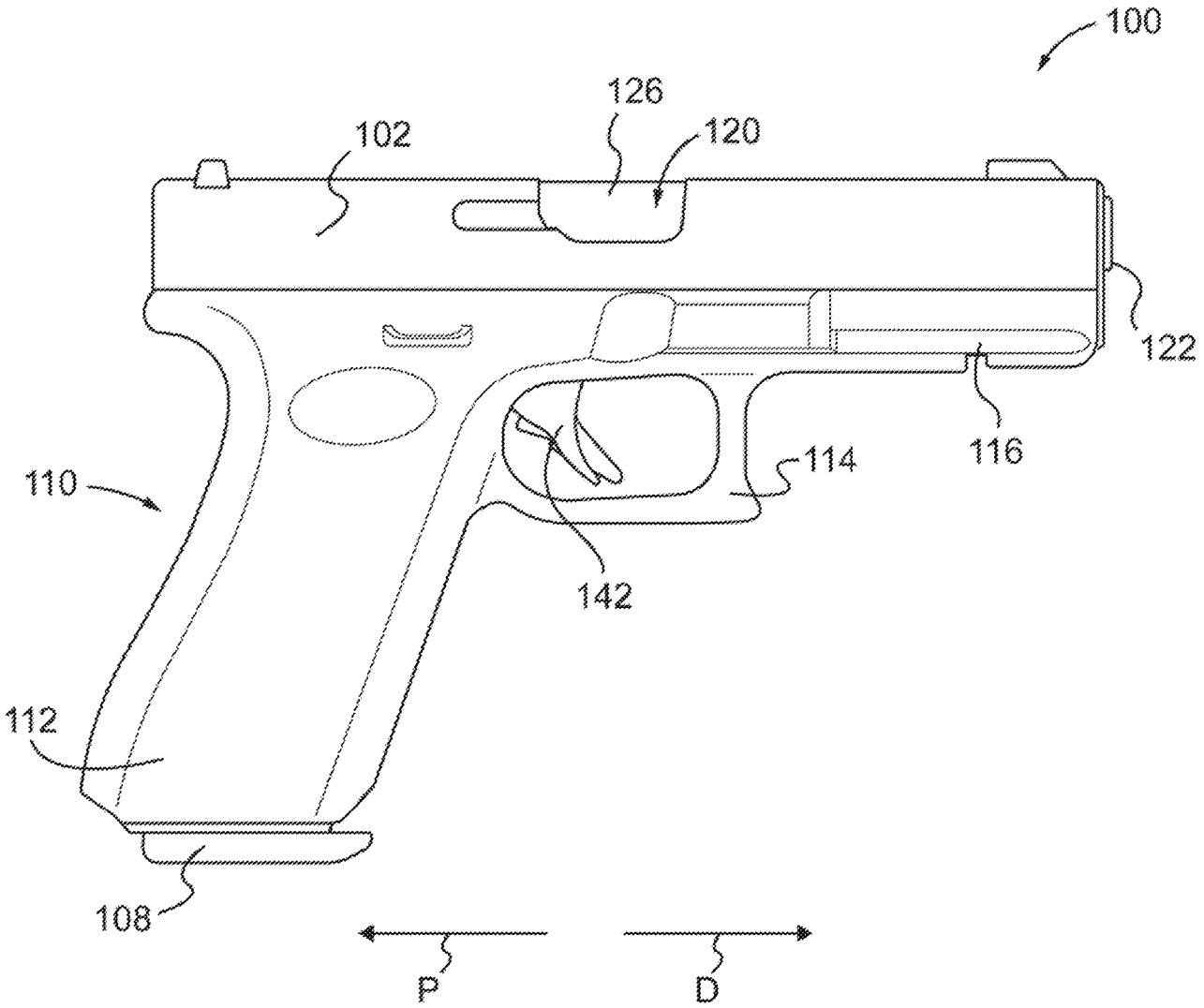
FIG. 1 is a side view of a firearm configured as a semi-automatic handgun.

Generally, the present disclosure is directed to systems and methods for making safe a firearm, and in particular for safing a handgun. As used herein, the making safe of a firearm includes the transitioning of the firearm from a state of readiness, in which a chambered cartridge may be discharged, to a safe condition, in which the unauthorized or accidental discharge of the firearm is precluded, even with a cartridge remaining in the chamber. Accordingly, the systems and methods disclosed herein may be employed to establish and maintain a separation distance between the firing pin of the handgun and the primer of a cartridge.

In some embodiments, the separation distance established and maintained by the safety systems disclosed herein is greater than the maximal distal travel of the firing pin. Accordingly, the firing pin is unable to contact the primer of the cartridge even if the firing mechanism of the handgun is actuated. In other words, the separation distance established by the safety system prevents the distal tip of the firing pin from contacting the primer (or a plane on which the primer would lie if a cartridge were seated in the chamber) under all locked conditions.

To establish the separation distance, the safety systems described herein include an engagement member that engages with a portion of the slide of the handgun. The engagement member receives a force, such as from the operator and/or a motive assembly (e.g., a motor, a compressed gas cylinder, or other similar assembly). The force is directed in a proximal direction (e.g., toward the grip of the handgun). The engagement member transfers at least a portion of the force to the slide, causing the slide to move proximally (e.g., toward the rear). As the firing pin is contained by the slide, the proximal movement of the slide also shifts the firing pin proximally. Since the chamber of the barrel remains longitudinally stationary (though some barrels may exhibit a relatively minimal rotational motion (e.g., a drop barrel)), the proximal movement of the slide establishes the separation distance.

The proximal movement of the slide is resisted by a recoil spring. The recoil spring is configured to exert a force on the slide in the distal direction so that, unless prevented, the slide will return to a default slide-forward position. The default slide-forward position is considered the nominal position of the slide, wherein the handgun may be discharged by the actuation (e.g., pulling or squeezing) of the trigger. Therefore, in order to maintain the separation distance, the engagement member is secured in a locked position via a lock mechanism. When the engagement member is secured in the lock position, the engagement member prevents the distal movement of the slide. In other words, in the lock position, the engagement member maintains the slide in a position that is shifted proximally from the nominal position of the slide.

To place the handgun in an operational state (e.g., with the slide in the nominal position), the lock mechanism is disengaged via a user interface. The user interface is configured to receive an input from an authorized user and disengage the lock mechanism. The user interface may, for example, include a fingerprint reader, a radio frequency identification reader, a numerical input apparatus, a microphone, a magnetic key, a mechanical key, and/or other input system configured to authenticate an authorized user. Once unlocked, the safety system remains unlocked until the locking mechanism is affirmatively reengaged by the operator.

In some embodiments, the proximal movement of the slide in response to the force exerted by the engagement member is sufficient to eject a cartridge from the chamber of the handgun. For example, the engagement member in such an embodiment has a range of travel that is sufficient to drive the slide to a proximal travel limit (e.g., in contact with a slide stop). As the slide is driven to the rear, an ejector mechanism of the handgun is also actuated by the movement of the slide and any chambered cartridge is ejected. Additionally, in such an embodiment, the disengagement of the locking mechanism will allow the engagement member and the slide to move rapidly in the distal direction. As the slide moves distally (as motivated by the recoil spring), a cartridge may be stripped from a loaded magazine and seated in the chamber via a nominal chambering operation of the handgun. As such, the safety system may be employed to clear the chamber of loaded firearm, maintain an open breach with the slide held to the rear, and facilitate the chambering of a cartridge. In other words, the unlocking of the safety system may cause a transition of the handgun to a chambered, operational state from which the handgun may be discharged.

As used herein, the term "about" when used in connection with a referenced numeric indication means the referenced numeric indication plus or minus up to 10 percent of that referenced numeric indication. For example, the language "about 50" covers the range of 45 to 55. Similarly, the language "about 5" covers the range of 4.5 to 5.5.

As used in this specification and the appended claims, the word "distal" refers to direction towards a target and away from a midline of an operator holding the handgun by the handle, such as in a firing orientation. Similarly, the word "proximal" refers to a direction away from the target and toward the midline of the operator. Thus, for example, the end of the barrel (e.g., the muzzle) from which a bullet departs under a nominal operation is closest to the target and would be the distal end of the handgun, and the end opposite the distal end (e.g., the portion of the handgun held by the operator when firing the handgun) would be the proximal end.

Further, specific words chosen to describe one or more embodiments and optional elements or features are not intended to limit the invention. For example, spatially relative terms— such as "beneath", "below", "lower", "above", "upper", "proximal", "distal", and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures is turned over, elements described as "below" or "beneath" other elements or features would then be "above" or "over" the other elements or features. Thus, the term "below" can encompass both positions and orientations of above and below. A device may be otherwise oriented (e.g., rotated 90 degrees or at other orientations) and the spatially relative descriptors used herein interpreted accordingly. Likewise, descriptions of movement along (translation) and around (rotation) various axes includes various spatial device positions and orientations.

Similarly, geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a", "an", and "the" are intended to include the plural forms as well, unless the context indicates otherwise. The terms "comprises", "includes", "has", and the like specify the presence of stated features, steps, operations, elements, components, etc. but do not preclude the presence or addition of one or more other features, steps, operations, elements, components, or groups.

Figure 2:
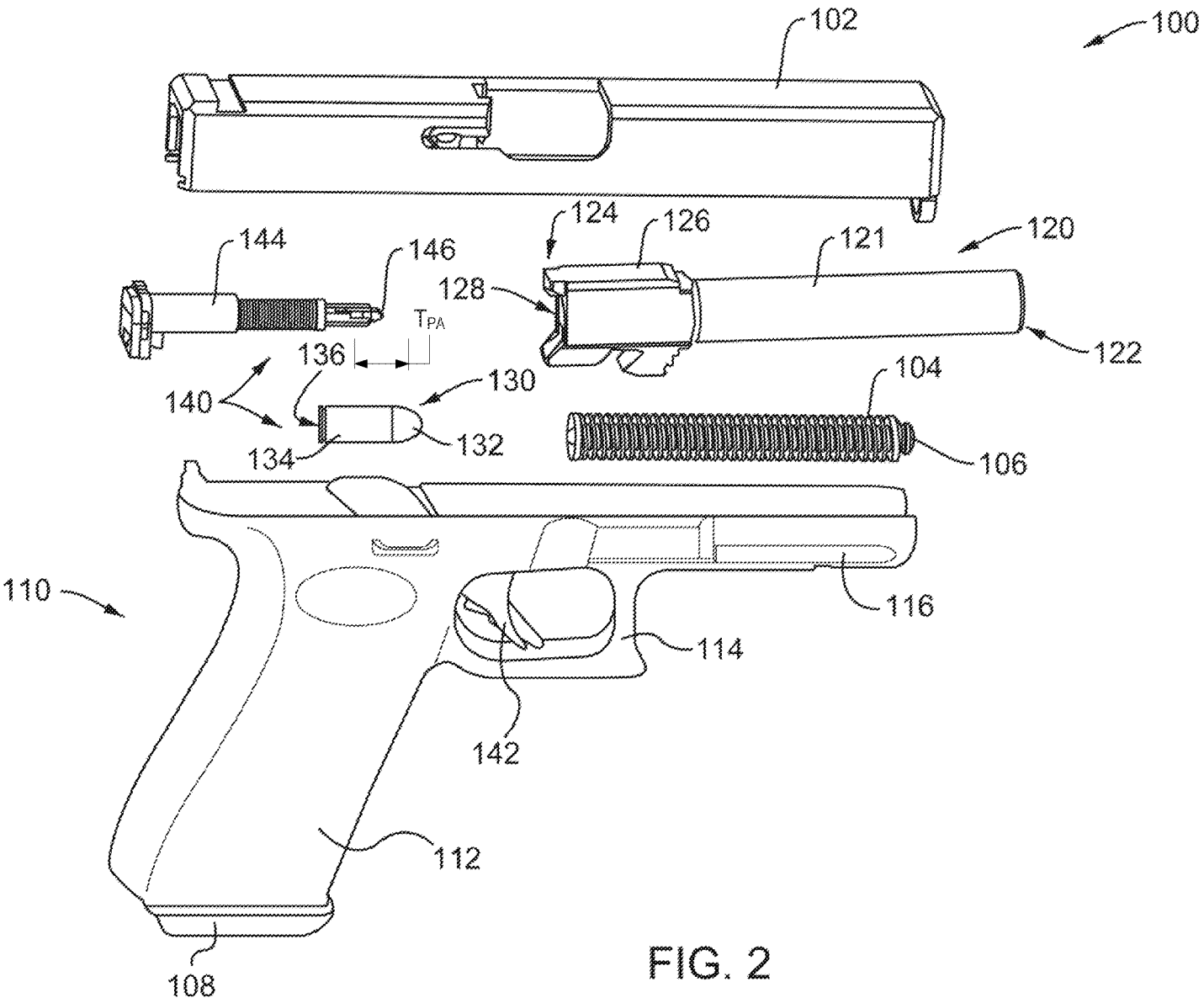
FIG. 2 is an exploded perspective view of the firearm of FIG. 1.

FIGS. 1 and 2 are a side view and an exploded perspective view of a firearm configured as a semi-automatic handgun 100. The handgun 100 includes a frame 110. The frame 110 is a unitary body that includes a grip portion 112. The grip portion 112 is oriented and shaped to be received by a hand of an operator of the handgun 100. The grip portion 112 defines a cavity for receiving a magazine 108. The magazine 108 may contain ammunition for the handgun 100. The frame 110 also includes a trigger guard 114 positioned distally (e.g., forward) of the grip portion 112. The trigger guard 114 at least partially surrounds the trigger 142 and partially restricts access thereto.

The frame 110 may also include a mounting structure 116 positioned distally relative to the trigger guard 114. In some embodiments, such as depicted in FIGS. 1 and 2, the mounting structure 116 is milled or otherwise formed into a lower surface of the frame 110. The mounting structure 116 may, for example, be a Picatinny rail, an accessory rail and/or other similar structure. The mounting structure 116 provides a mounting platform for firearm accessories, such as the safety system described herein, a tactical light, a laser aiming module, a camera, or other suitable accessory.

The handgun 100 also includes a slide 102 that is movably coupled (e.g., slidingly coupled) to the frame 110. The slide 102 is the top portion of the handgun 100 and has a long axis that extends generally horizontally when the handgun 100 is oriented a nominal employment orientation. During operation of the handgun 100, the slide 102 is configured to translate first in a proximal direction (P) and then in a distal direction (D) relative to the frame 110 following the discharge of the handgun 100.

As illustrated in FIG. 2, the handgun 100 includes a recoil spring 104. The recoil spring 104 is axially aligned with and circumscribes a recoil spring guide 106. The recoil spring 104 is positioned so that a proximal movement of the slide 102 relative to the frame compresses the recoil spring 104. The recoil spring 104 is thus oriented to exert a force on the slide 102 in a distal direction. For example, under nominal operations (e.g., an authorized, intentional actuation of the trigger 142), the discharge of the handgun 100 results in the proximal movement of the slide 102 relative to the frame 110 and, thus, the compression of the recoil spring 104. When the slide 102 encounters a proximal travel limit (e.g., a slide stop), the potential energy of the recoil spring 104 is released, thereby returning the slide 102 distally to a nominal position (e.g., a slide-forward position such as depicted in FIG. 1).

The handgun 100 also includes a barrel 120 supported by the slide 102. The barrel 120 is a tubular metallic structure through which a projectile 132 (e.g., a bullet) or shot charge is fired. The barrel 120 is a unitary body that extends between a muzzle 122 and a chamber end 124 (e.g., a proximal end of the barrel 120). The muzzle 122 corresponds to the distal end of the barrel from which the projectile 132 exits following discharge. The muzzle 122 is the distal end of a generally linear portion 121 of the barrel 120. The linear portion 121 of the barrel 120 has a generally uniform outer diameter and defines a hollow internal lumen (e.g., a bore) of the barrel 120. In some embodiments, the linear portion 121 extends distally from a barrel block 126. The barrel block 126 is an enlarged portion of the barrel 120 that may be configured to interface with the slide 102. The barrel block 126 also defines a chamber 128. The chamber 128 is a hollow internal lumen of the barrel 120 that is axially aligned with the bore and holds a cartridge 130 ready for firing/discharge.

In some embodiments, the handgun 100 is configured to discharge a cartridge 130 in order to engage a target. The cartridge 130 includes a projectile 132 at least partially contained within the casing 134. The casing 134 may contain a quantity of a propellant in fluid communication with a primer 136. The projectile 132 has an outer diameter that is less than the bore, while the casing 134 has an outer diameter that is less than the inner diameter of the chamber but is greater than the bore. In other words, the casing 134 is configured to be seated at least partially within the chamber 128, with at least a portion of the projectile 132 extending distally into the bore. In embodiments, a transition of the barrel 120 from the chamber 128 to the bore may define a maximal insertion distance of the casing 134 within the barrel 120, therefore defining a position of the primer 136 relative to the frame 110 adjacent the chamber end 124.

In some embodiments, the handgun 100 may be discharged via a firing mechanism 140. The firing mechanism includes a trigger 142 operably coupled to a primer actuator 144 (e.g., a firing pin) via a linkage mechanism. The primer actuator 144 may, for example, be a rigid rod or other suitable structure. The primer actuator 144 includes a distal end 146 configured to impart a force to the primer 136 of a chambered cartridge 130 in response to an actuation of the trigger 142 to discharge the handgun 100.

The distal end 146 of the primer actuator 144 has a nominal range of travel ($T_{PA}$). In some embodiments nominal range of travel ($T_{PA}$) is defined between a maximal proximal position of the distal end 146 when the handgun 100 is prepared to fire (e.g., cocked) and a point of maximal travel in the distal direction attained by the distal end 146 in response to a force imparted to the primer actuator 144. For example, in some embodiments, the handgun 100 is a striker-fired handgun with the primer actuator 144 being a striker assembly. In such an embodiment, the initial actuation of the trigger 142 exerts a force on the firing pin in the proximal direction to transition the distal end 146 from a nominal position ($P_N$) (FIG. 3) along the nominal range of travel ($T_{PA}$). This force also applies a tension to a spring of the striker assembly and fully cocks the handgun 100. As the actuation of the trigger 142 continues, the trigger 142 is operably decoupled from the striker assembly and the spring imparts a force on the firing pin in the distal direction, resulting in the positioning of the distal end 146 at the point of maximal distal travel. In an additional embodiment, the handgun 100 is a hammer-fired handgun 100 wherein cocking the handgun 100 places an external hammer under a tensile load. In such an embodiment, the distal end 146 is positioned at a nominal position ($P_N$) (FIG. 3) along the nominal range of travel ($T_{PA}$) when the handgun 100 is both cocked and uncocked. Upon actuation of the trigger, the hammer is released, and a force is imparted on the firing pin in the distal direction, resulting in the positioning of the distal end 146 at the point of maximal distal travel. It should be appreciated that the point of maximum travel in a distal direction extends distally beyond a point of contact (e.g., a primer activation plane ($PL_{ACT}$) (FIG. 3)) with the primer 136.

Figure 3:
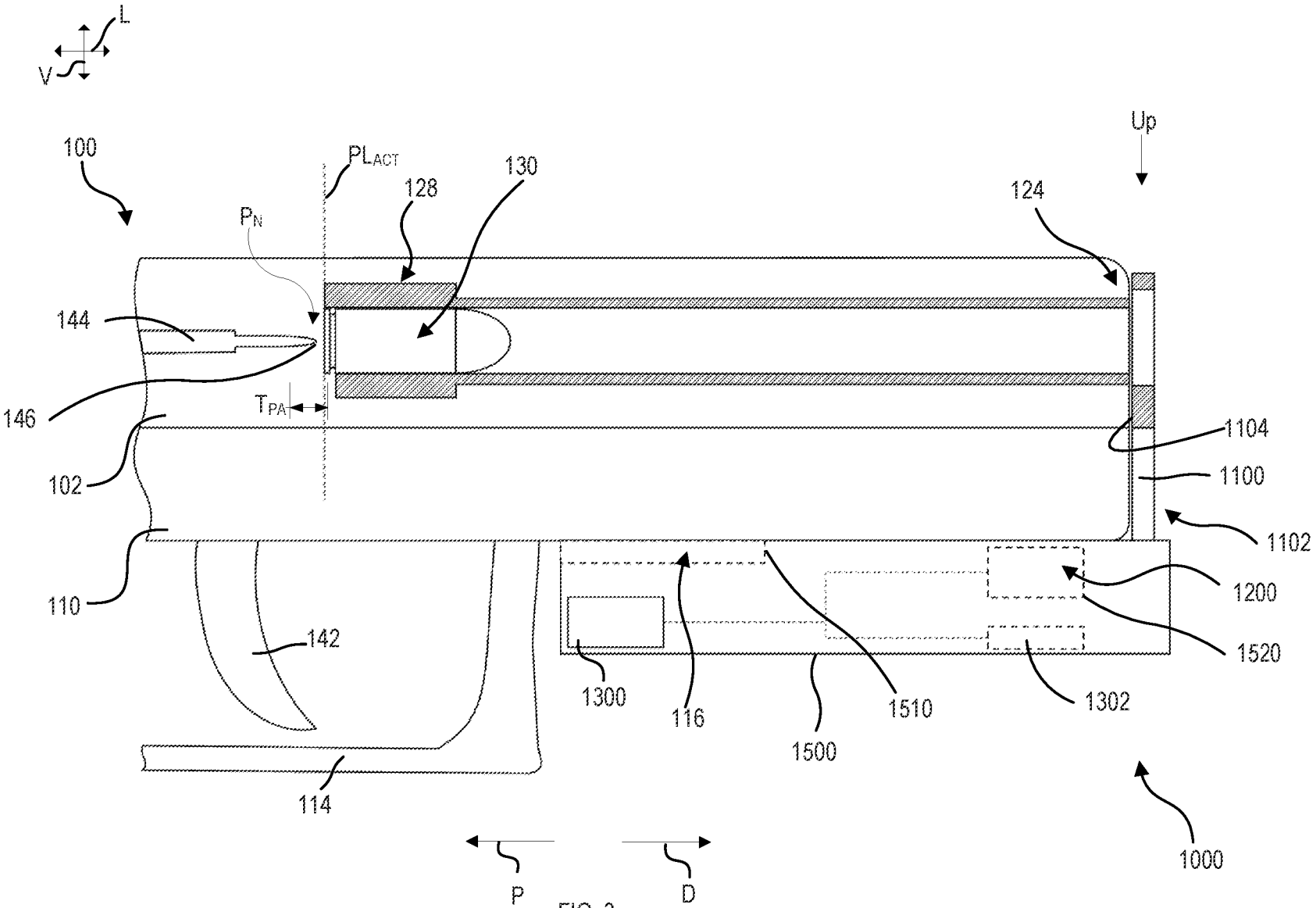
FIG. 3 is a diagrammatic illustration of a safety system for a handgun coupled to a portion of the handgun, with the safety system being depicted in an unlocked configuration.
Figure 4:
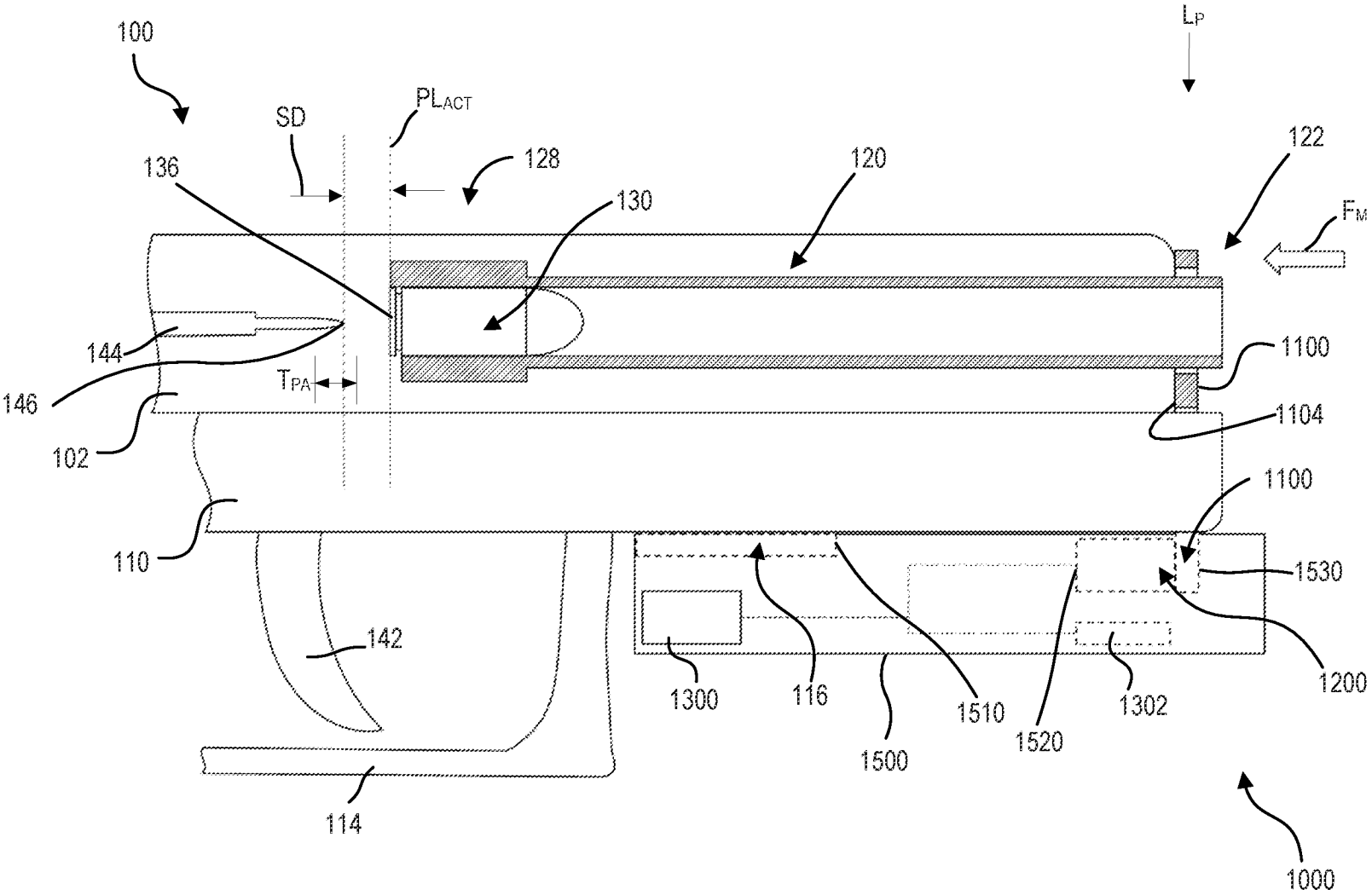
FIG. 4 is a diagrammatic illustration of the safety system of FIG. 3, with the safety system being depicted in a locked configuration wherein the slide of the handgun is displaced rearward (proximally) by a force exerted via an engagement member of the safety system.

FIGS. 3 and 4 are diagrammatic illustrations of a safety system 1000 for a handgun coupled to a portion of the handgun 100. The safety system 1000 develops a forced malfunction of the handgun 100 that precludes the handgun 100 from discharging when the safety system 1000 is in a locked configuration. In some embodiments, the safety system 1000 is coupled to an existing handgun 100 as depicted in FIGS. 3 and 4. However, in additional embodiments, the safety system 1000 may be integrated into a newly manufactured handgun 100. Although shown and described as being coupled to the handgun 100, the safety system 1000 can be coupled to and/or used with any suitable firearm.

In FIG. 3, the safety system 1000 is depicted in an unlocked configuration, while in FIG. 4, the safety system 1000 is depicted in a locked configuration. The safety system 1000 includes an engagement member 1100, a lock mechanism 1200, and a user interface 1300. As described in more detail below, the safety system 1000 can allow the handgun 100 to be selectively locked (or placed in a safe, "no-fire" condition) and unlocked while remaining coupled to the handgun 100. The engagement member 1100 is arranged orthogonal to the longitudinal axis of the handgun 100 and is movably coupled to the handgun 100. The engagement member 1100 includes an actuator portion 1102 and a contact face 1104. In other words, the engagement member 1100 may, in various embodiments, be configured to move/translate (e.g., slide, rotate, pivot, and/or tilt) relative to the frame 110 in accordance with the locked/unlocked configuration of the safety system 1000. The movement/translation of the engagement member 1100 is the result of a motive force ($F_M$) received by the actuator portion 1102 of the engagement member 1100. For example, in some embodiments the actuator portion 1102 can include a surface or portion that allows a user to manually grasp or manipulate the engagement member 1100 to move the engagement member 1100 relative to the frame 110. In other embodiments, the actuator portion 1102 is operably coupled to receive the motive force ($F_M$) from a motive assembly (not shown). It should be appreciated that the motive force ($F_M$) has a magnitude that is greater than that of a force exerted on the slide 102 by the recoil spring 104.

As depicted in FIGS. 3 and 4, the engagement member 1100 includes the contact face 1104 that is configured to contact a portion of the slide 102. Thus, in certain operational conditions, movement of the engagement member 1100 can produce movement of the slide 102. In other operational conditions, the contact between contact face 1104 and the slide 102 can limit movement of the slide 102. In some embodiments, the contact face 1104 is in contact with a portion of the slide 102 when the safety system 1000 is both in the locked configuration and in the unlocked configuration. In other embodiments, a clearance may be established between the contact face 1104 and the portion of the slide 102 when the safety system 1000 is in the unlocked configuration, such as depicted in FIG. 3. Similarly stated, the contact face 1104 can be spaced apart from the slide 102 when the safety system 1000 is in the unlocked configuration. In some embodiments, the contact between the contact face 1104 and the portions slide 102 facilitates the transfer of a portion of the motive force ($F_M$) to the slide 102 in a proximal direction (P).

The engagement member 1100 is configured to move relative to the frame 110 between a lock position ($L_P$) (as depicted in FIG. 4) and an unlock position ($U_P$) (as depicted in FIG. 3). In some embodiments, the engagement member 1100 is configured to transition between the lock position ($L_P$) and the unlock position ($U_P$) while remaining movably coupled to the handgun 100. In other words, in some embodiments, the engagement member 1100 (and the safety system 1000) remains coupled to the handgun 100 when transitioned between the lock and unlock positions. For example, in some embodiments the engagement member 1100, is configured to move linearly between the lock position ($L_P$) and the unlock position ($U_P$). The lock position ($L_P$) corresponds to a separation distance (SD) between the distal end 146 of the primer actuator 144 of the handgun 100 and a primer activation plane ($PL_{ACT}$) of the handgun 100. In other words, the movement of the slide 102 (and the resultant longitudinal movement of the supported primer actuator 144) in response to the portion of the motive force ($F_M$) transferred by the engagement member 1100 transitioning to the lock position ($L_P$) establishes the separation distance (SD). Said another way, the proximal movement of the slide 102 results in a proximal shift of the nominal range of travel ($T_{PA}$) of the primer actuator 144 relative to the frame 110, and thus the barrel 120.

The separation distance (SD) has a magnitude that precludes contact between the distal end 146 of the primer actuator 144 (e.g., the firing pin) and the primer 136 of a chambered cartridge 130 even if the firing mechanism 140 is actuated. Said another way, the magnitude of the separation distance (SD) is such that the point of maximal distal travel (e.g., the distal limit of the nominal range of travel ($T_{PA}$)) is proximal to, and separated from, the primer activation plane ($PL_{ACT}$). Insofar as the separation distance (SD) precludes any contact between the primer actuator 144 and the primer 136, the handgun 100 is rendered inoperable (e.g., made safe) so long as the separation distance (SD) is maintained.

The primer activation plane ($PL_{ACT}$) is a plane orthogonal to the longitudinal axis (L) of the handgun 100. The primer activation plane ($PL_{ACT}$) corresponds to the nominal longitudinal position at which a proximal face of the primer 136 would lie if/when a cartridge 130 were/is seated in the chamber 128. In other words, the primer activation plane ($PL_{ACT}$) corresponds to the longitudinal position at which the distal end 146 would first contact the primer 136 during the discharging of the handgun 100. In some embodiments, the primer activation plane ($PL_{ACT}$) may be congruent with a plane defined by a maximal proximal portion of the chamber end 124 of the barrel 120.

As depicted in FIG. 3, the unlock position ($U_P$) corresponds to a nominal position ($P_N$) of the distal end 146 of the primer actuator 144 along the nominal range of travel ($T_{PA}$). The nominal position ($P_N$) may be proximal to the primer activation plane ($PL_{ACT}$) such that a nominal clearance exists between the distal end 146 and the primer 136. In some embodiments, the nominal position ($P_N$) corresponds to the longitudinal position of the distal end 146 when the handgun 100 is in an uncocked state with the slide 102 in the default, slide-forward position, such as depicted in FIGS. 1 and 3. However, in additional embodiments, the nominal position ($P_N$) corresponds to the nominal longitudinal position of the distal end 146 when the handgun 100 is in a half-cocked state or a cocked (e.g., fully cocked) state with the slide 102 in the default, slide-forward position. In other words, when the engagement member 1100 is in the unlock position ($U_P$), the handgun 100 may be in an operational state/condition from which the handgun 100 may be discharged to engage a target.

In some embodiments, the safety system 1000 includes the lock mechanism 1200, which is operably coupled to the engagement member 1100. The lock mechanism 1200 is positioned to restrict the movement of the engagement member 1100 from the locked position ($L_P$) while the lock mechanism is engaged. In other words, the lock mechanism 1200 maintains the engagement member 1100 (and therefore the engaged slide 102) in a fixed position (e.g., the position ($L_P$)) relative to the frame 110. In some embodiments, the lock mechanism 1200 may be a mechanical lock mechanism wherein the lock mechanism 1200 mechanically engages a portion of the engagement member 1100, such as via at least one pin, a catch, a locking bar, a cam, and/or other suitable structure. In some embodiments, the lock mechanism 1200 may utilize a magnetic force to restrict the movement of the engagement member 1100. For example, the lock mechanism 1200 may be configured to magnetically engage the engagement member 1100 directly or may utilize a magnetic field to restrict the rotation of a component (e.g., a lead screw) of the safety system 1000 to which the engagement member 1100 is rotationally coupled.

As further depicted in FIGS. 3 and 4, the safety system 1000 includes the user interface 1300, which is operably coupled to the lock mechanism 1200. The user interface 1300 is configured to transition the lock mechanism 1200 between an engaged state and a disengaged state. In other words, the user interface 1300 is employed by an authorized user to facilitate the movement of the engagement member 1100 between the lock position ($L_P$) and the unlock position ($U_P$) by locking or unlocking the lock mechanism 1200.

Once unlocked, the safety system 1000 remains unlocked until the locking mechanism 1200 is affirmatively reengaged by an operator.

The user interface 1300 may include a biometric user identification (e.g., fingerprint identification) unit, a radio frequency identification reader, a numerical input apparatus, a microphone, a magnetic key, a mechanical key, and/or other input system configured to authenticate an authorized user. For example, the user interface 1300 may, in some embodiments, include a fingerprint sensor operably coupled to a biometric processor and a data storage device containing stored identification data for authorized users. The fingerprint sensor may be an optical sensor, a thermal sensor, and/or a pressure sensor and may be configured as a static sensor or a swipe sensor. Additionally, in some embodiments the user interface 1300 includes a wireless communication unit that facilitates the remote operation of the safety system 1000 via a wireless network, a cellular network, and/or a Bluetooth connection.

In some embodiments, a GPS module 1302 is operably coupled to the user interface 1300. The GPS module 1302 facilitates position tracking of the handgun 100 via the safety system 1000 coupled thereto. For example, the GPS module 1302 may the employed in conjunction with a geo-fence (e.g., a region with boundaries that are defined by GPS coordinates). In some embodiments an embodiment, an authorized user of the handgun 100 may be alerted in the event the handgun 100 departs the geo-fence. In additional embodiments, the user interface 1300 may be disabled upon the departure of the handgun 100 from the geo-fence. In further embodiments, the user interface 1300 may be configured to transition the lock mechanism 1200 to, or maintain the lock mechanism 1200 in, the engaged state following the departure of the handgun 100 from the geo-fence.

In some embodiments, the safety system 1000 includes a housing 1500. The housing 1500 provides the structure for support and mounting of the safety system 1000 to the handgun 100. The housing 1500 is formed from materials having sufficient strength to prevent access to internal components of the safety system 1000. For example, in various embodiments, the housing 1500 is formed from a metal, a reinforced plastic, and/or composite. In some embodiments, the housing 1500 is the unitary structure defining at least one internal cavity. In other embodiments, the housing 1500 is formed by the coupling of multiple housing members that are separately formed. For example, the housing 1500 may be formed at least from a first housing half and a second housing half.

As depicted in FIGS. 3 and 4, the housing 1500 supports the user interface 1300. For example, the housing 1500 may define an external recess in which the user interface 1300 may be secured. The housing 1500 includes a coupling portion 1510. The coupling portion 1510 is configured to receive a portion of the handgun 100, such as the mounting structure 116. In other words, the housing 1500, and thus the safety system 1000, may be fixedly coupled to the handgun 100 via an interface between the coupling portion 1510 and the mounting structure 116. The housing 1500 may, for example, be coupled to the handgun 100 and a position that is forward of the trigger guard 114. As depicted in FIGS. 3 and 4 the positioning of safety system 1000, in some embodiments, establishes a spacing between the housing 1500 and the trigger guard 114. However, in some embodiments, the housing 1500 is formed to conform with a portion of the trigger guard 114 and is positioned in contact therewith.

In some embodiments, the housing 1500 also defines a lock cavity 1520 supporting at least a portion of the lock mechanism 1200. The lock cavity 1520 may, for example, be defined by an inner face of the housing 1500. Additionally, the housing 1500 defines an interface orifice 1530. The interface orifice 1530 is oriented to facilitate the operable coupling of the engagement member 1100 to the lock mechanism 1200. The interface orifice 1530 may, for example, correspond to a slot or hole through which a portion of the engagement member 1100 may be inserted. The interface orifice 1530 is sized to facilitate a desired degree of travel of the engagement member 1100.

Figure 5:
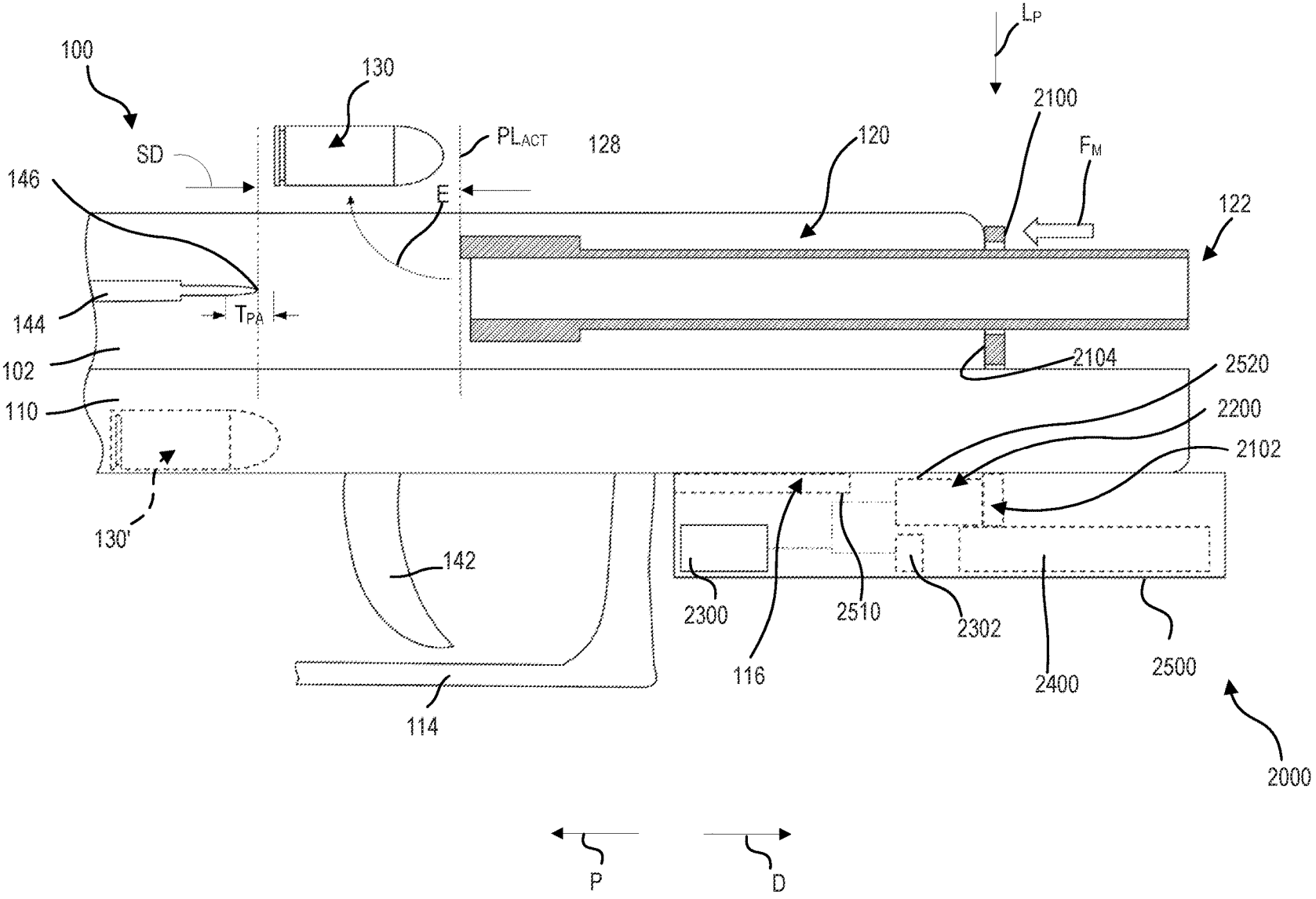
FIG. 5 is a diagrammatic illustration of an embodiment of the safety system for a handgun coupled to a portion of a handgun, particularly illustrating the ejecting of a cartridge via the safety system during a transition to a locked configuration.
Figure 6:
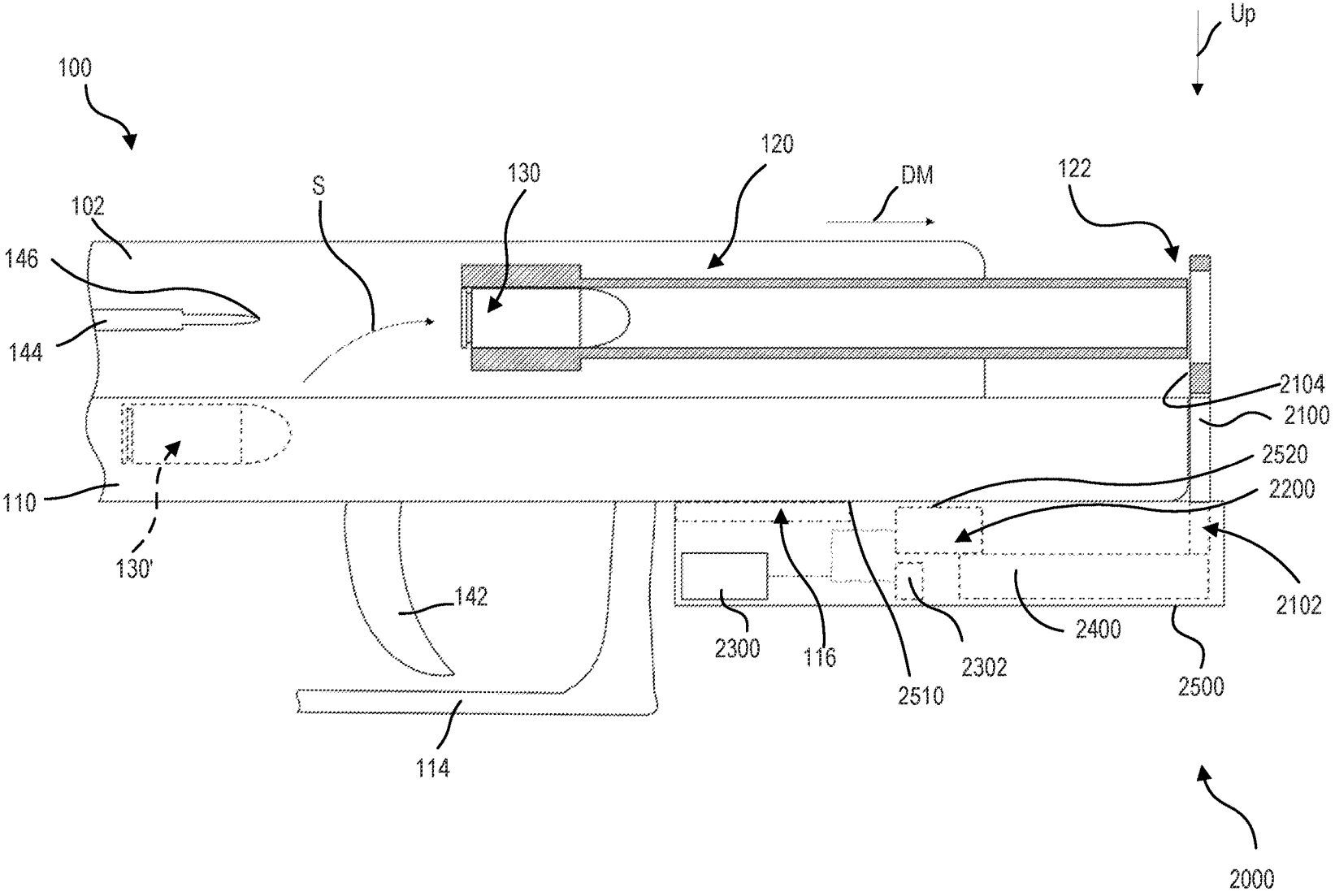
FIG. 6 is a diagrammatic illustration of the safety system of FIG. 5, particularly illustrating the chambering of a cartridge during the unlocking of the safety system.

Although the safety system 1000 is described above as allowing a user to manually grasp or manipulate the engagement member 1100 to move the engagement member 1100 relative to the frame 110, in other embodiments, any of the safety systems described herein can include a motive assembly that produces a motive force ($F_M$) to move the engagement member. For example, FIGS. 5 and 6 are diagrammatic illustrations of a safety system 2000 for a handgun coupled to a portion of the handgun 100. As described for previous embodiments, in some embodiments the safety system 2000 develops a forced malfunction of the handgun 100 that precludes the handgun 100 from discharging when the safety system 2000 is in a locked configuration. In some embodiments, the safety system 2000 is coupled to an existing handgun 100 as depicted in FIGS. 5 and 6. Although shown and described as being coupled to the handgun 100, the safety system 2000 can be coupled to and/or used with any suitable firearm.

In FIG. 5, the safety system 2000 is depicted in a locked configuration, while in FIG. 6, the safety system 2000 is depicted in an unlocked configuration. The safety system 2000 includes a housing 2500, an engagement member 2100, a lock mechanism 2200, a user interface 2300, and a motive assembly 2400. As described in more detail below, the safety system 2000 can allow the handgun 100 to be selectively locked (or placed in a safe, "no-fire" condition) and unlocked while remaining coupled to the handgun 100. The engagement member 2100 is movably coupled to the handgun 100 and includes an actuator portion 2102 and a contact face 2104. In other words, the engagement member 2100 may, in various embodiments, be configured to move/translate (e.g., slide, rotate, pivot, and/or tilt) relative to the frame 110 in accordance with the locked/unlocked configuration of the safety system 2000. The movement/translation of the engagement member 2100 is the result of a motive force ($F_M$) received by the actuator portion 2102 of the engagement member 2100. For example, in some embodiments the actuator portion 2102 is operably coupled to receive the motive force $F_M$ from a motive assembly 2400.

As depicted in FIGS. 5 and 6, the engagement member 2100 includes the contact face 2104 that is configured to contact a portion of the slide 102. Thus, in certain operational conditions, movement of the engagement member 2100 can produce movement of the slide 102. In other operational conditions, the contact between contact face 2104 and the slide 102 can limit movement of the slide 102. In some embodiments, a clearance may be established between the contact face 2104 and the portion of the slide 102 when the safety system 2000 is in the unlocked configuration. Similarly stated, the contact face 2104 can be spaced apart from the slide 102 when the safety system 2000 is in the unlocked configuration. In some embodiments, the contact between the contact face 2104 and the portions slide 102 facilitates the transfer of a portion of the motive force ($F_M$) to the slide 102 in a proximal direction (P).

As described for previous embodiments, in some embodiments the engagement member 2100 is configured to move relative to the frame 110 between a lock position ($L_P$) (as depicted in FIG. 6) and an unlock position ($U_P$) (as depicted in FIG. 5). In some embodiments, the engagement member 2100 is configured to transition between the lock position ($L_P$) and the unlock position ($U_P$) while remaining movably coupled to the handgun 100. In other words, in some embodiments, the engagement member 2100 (and the safety system 2000) remains coupled to the handgun 100 when transitioned between the lock and unlock positions. For example, in some embodiments the engagement member 2100, is configured to move linearly between the lock position ($L_P$) and the unlock position ($U_P$). The lock position ($L_P$) corresponds to a separation distance (SD) between the distal end 146 of the primer actuator 144 of the handgun 100 and a primer activation plane ($PL_{ACT}$) of the handgun 100. In other words, the movement of the slide 102 (and the resultant longitudinal movement of the supported primer actuator 144) in response to the portion of the motive force ($F_M$) transferred by the engagement member 2100 transitioning to the lock position ($L_P$) establishes the separation distance (SD). Said another way, the proximal movement of the slide 102 results in a proximal shift of the nominal range of travel ($T_{PA}$) of the primer actuator 144 relative to the frame 110, and thus the barrel 120.

The separation distance (SD) has a magnitude that precludes contact between the distal end 146 of the primer actuator 144 (e.g., the firing pin) and the primer 136 of a chambered cartridge 130 even if the firing mechanism 140 is actuated. Said another way, the magnitude of the separation distance (SD) is such that the point of maximal distal travel (e.g., the distal limit of the nominal range of travel ($T_{PA}$)) is proximal to, and separated from, the primer activation plane ($PL_{ACT}$). Insofar as the separation distance (SD) precludes any contact between the primer actuator 144 and the primer 136, the handgun 100 is rendered inoperable (e.g., made safe) so long as the separation distance (SD) is maintained.

The primer activation plane ($PL_{ACT}$) is a plane orthogonal to the longitudinal axis (L) of the handgun 100. The primer activation plane ($PL_{ACT}$) corresponds to the nominal longitudinal position at which a proximal face of the primer 136 would lie if/when a cartridge 130 were/is seated in the chamber 128. In other words, the primer activation plane ($PL_{ACT}$) corresponds to the longitudinal position at which the distal end 146 would first contact the primer 136 during the discharging of the handgun 100. In some embodiments, the primer activation plane ($PL_{ACT}$) may be congruent with a plane defined by a maximal proximal portion of the chamber end 124 of the barrel 120.

In some embodiments, the lock position ($L_P$) corresponds to a fully-retracted position of the slide 102. In other words, when the engagement member 2100 is in the lock position ($L_P$), the slide 102 is at a point of maximal proximal travel (e.g., in contact with a proximal stop). Said another way, in some embodiments, when the engagement member 2100 is in the lock position ($L_P$), the slide 102 is to the rear. The lock position ($L_P$) corresponding to the fully-retracted position of the slide 102 also corresponds to a maximal separation distance (SD) between the distal end 146 of the primer actuator 144 of the handgun 100 and the primer activation plane ($PL_{ACT}$) of the handgun 100.

As depicted in FIG. 5, in some embodiments, the movement of the slide 102 in the proximal direction in response to the motive force ($F_M$) applied via the engagement member 2100 ejects (as shown by the arrow E) a cartridge 130 from the chamber 128 of the barrel 120. In other words, when the safety system 2000 is actuated to make safe the handgun 100, the transition of the engagement member 2100 to the lock position ($L_P$) (e.g., the proximal movement of the engagement member 2100) facilitates the ejecting (E) of a chambered cartridge 130. The cartridge 130 is the ejected (E) via an ejector mechanism (not shown) of the handgun 100. It should be appreciated that ejecting (E) the cartridge 130 during the making safe of the handgun 100 may facilitate the storage of the handgun 100 with an empty chamber 128.

The unlock position ($U_P$) corresponds to a nominal position of the distal end 146 of the primer actuator 144 along the nominal range of travel ($T_{PA}$). The nominal position may be proximal to the primer activation plane ($PL_{ACT}$) such that a nominal clearance exists between the distal end 146 and the primer 136. In some embodiments, the nominal position corresponds to the longitudinal position of the distal end 146 when the handgun 100 is in an uncocked state with the slide 102 in the default, slide-forward position. However, in additional embodiments, the nominal position corresponds to the nominal longitudinal position of the distal end 146 when the handgun 100 is in a half-cocked state or a cocked (e.g., fully cocked) state with the slide 102 in the default, slide-forward position. In other words, when the engagement member 2100 is in the unlock position ($U_P$), the handgun 100 may be in an operational state/condition from which the handgun 100 may be discharged to engage a target.

As depicted in FIG. 6, in some embodiments transitioning the engagement member 2100 from the lock position ($L_P$) to the unlock position ($U_P$) facilitates a distal movement (see the arrow DM) of the slide 102. In other words, the transition (e.g., the linear movement) of the engagement member 2100 to the unlock position ($U_P$) may remove a restriction on the longitudinal movement (e.g., movement in the distal direction relative to the frame 110) of the slide 102, thereby allowing the slide 102 to return to the nominal, default slide-forward position (as depicted in FIG. 1) in response to the force applied via the recoil spring 104.

In some embodiments, the distal movement (DM) of the slide 102 seats (shown by the arrow S) a cartridge 130 in the chamber 128 of the handgun 100. For example, unlocking of the safety system 2000 permits the transition of the engagement member 2100 from the lock position ($L_P$) to the unlock position ($U_P$). This transition allows the slide 102 to move distally. In accordance with the nominal operation of the handgun 100, the distal movement of the slide 102 strips a cartridge 130' from a loaded magazine (not shown) inserted in the handgun 100 and seats (S) the cartridge 130 in the chamber 128. In other words, in some embodiments, the unlocking of the safety system 2000 results in the chambering of a cartridge 130 (e.g., seating (S) a cartridge 130 in the chamber 128) and the placing of the handgun 100 in an operational state, from which the handgun 100 may be discharged/employed.

In some embodiments, the safety system 2000 includes the lock mechanism 2200, which is operably coupled to the engagement member 2100. The lock mechanism 2200 is positioned to restrict the movement of the engagement member 2100 from the locked position ($L_P$) while the lock mechanism is engaged. In other words, the lock mechanism 2200 maintains the engagement member 2100 (and therefore the engaged slide 102) in a fixed position (e.g., the position ($L_P$)) relative to the frame 110. In some embodiments, the lock mechanism 2200 may be a mechanical lock mechanism wherein the lock mechanism 2200 mechanically engages a portion of the engagement member 2100, such as via at least one pin, a catch, a locking bar, a cam, and/or other suitable structure. In some embodiments, the lock mechanism 2200 may utilize a magnetic force to restrict the movement of the engagement member 2100. For example, the lock mechanism 2200 may be configured to magnetically engage the engagement member 2100 directly or may utilize a magnetic field to restrict the rotation of a component (e.g., a lead screw) of the safety system 2000 to which the engagement member 2100 is rotationally coupled.

As further depicted in FIGS. 5 and 6, the safety system 2000 includes the user interface 2300, which is operably coupled to the lock mechanism 2200. The user interface 2300 is configured to transition the lock mechanism 2200 between an engaged state and a disengaged state. In other words, the user interface 2300 is employed by an authorized user to facilitate the movement of the engagement member 2100 between the lock position ($L_P$) and the unlock position ($U_P$) by locking or unlocking the lock mechanism 2200. Once unlocked, the safety system 2000 remains unlocked until the locking mechanism 2200 is affirmatively reengaged by an operator.

The user interface 2300 may include a biometric user identification (e.g., fingerprint identification) unit, a radio frequency identification reader, a numerical input apparatus, a microphone, a magnetic key, a mechanical key, and/or other input system configured to authenticate an authorized user. For example, the user interface 2300 may, in some embodiments, include a fingerprint sensor operably coupled to a biometric processor and a data storage device containing stored identification data for authorized users. The fingerprint sensor may be an optical sensor, a thermal sensor, and/or a pressure sensor and may be configured as a static sensor or a swipe sensor. Additionally, in some embodiments the user interface 2300 includes a wireless communication unit that facilitates the remote operation of the safety system 2000 via a wireless network, a cellular network, and/or a Bluetooth connection.

In some embodiments, a GPS module 2302 is operably coupled to the user interface 2300. The GPS module 2302 facilitates position tracking of the handgun 100 via the safety system 2000 coupled thereto. For example, the GPS module 2302 may the employed in conjunction with a geo-fence (e.g., a region with boundaries that are defined by GPS coordinates). In some embodiments an embodiment, an authorized user of the handgun 100 may be alerted in the event the handgun 100 departs the geo-fence. In additional embodiments, the user interface 2300 may be disabled upon the departure of the handgun 100 from the geo-fence. In further embodiments, the user interface 2300 may be configured to transition the lock mechanism 2200 to, or maintain the lock mechanism 2200 in, the engaged state following the departure of the handgun 100 from the geo-fence.

As depicted in FIGS. 5 and 6, the safety system 2000 includes a motive assembly 2400. The motive assembly 2400 is operably coupled to the actuator portion 2102 of the engagement member 2100. The motive assembly 2400 is configured to generate the motive force ($F_M$). In some embodiments, the motive force ($F_M$) is generated in response to a user input, such as may be received via the user interface 2300. The motive assembly 2400 may include a motor assembly, a pneumatic assembly, and/or a spring assembly configured to generate the motive force ($F_M$). For example, in some embodiments the motor assembly may include a lead screw (e.g., similar to the lead screw 4440 shown in FIG. 12) that is rotatable by an electric motor (e.g., similar to the motor 4420 shown in FIG. 12). Additionally, in some embodiments, the pneumatic assembly may include a replaceable gas canister (not shown) containing a gas. In other words, the motive assembly 2400 includes a mechanism that transforms thermal, chemical, electrical, pressure, or any other source of energy into the mechanical energy represented by the motive force ($F_M$).

In some embodiments, the safety system 2000, via the motive assembly 2400, may facilitate the single-handed chambering of a cartridge 130 and/or clearing of a malfunction of the handgun 100 via the cycling of the handgun 100. More specifically, the handgun 100 may be maintained in a deployed orientation (e.g., with the muzzle 122 pointed downrange) in the hand of an authorized user while the authorized user actuates the unlocked safety system 2000. The authorized user may actuate the safety system 2000 via an engagement of the user interface 2300 with a portion (e.g., a finger) of the same hand holding the handgun 100. Upon actuation, the motive assembly 2400 may drive the engagement member 2100, and thus the slide 102, proximally (e.g., rearward). The proximal motion of the engagement member 2100 and the slide 102 may continue until the slide 102 encounters a slide stop. The proximal motion of the slide 102 may eject any chambered, misfed, or jammed cartridge 130. Once the slide 102 has moved proximally a maximal distance, the authorized user may unlock the safety system 2000 via an engagement of the user interface 2300 with the portion of the same hand holding the handgun 100. The user interface 2300 may be engaged by the portion of the hand of the authorized user while continuing to maintain the handgun 100 in the deployed orientation. With the safety system 2000 unlocked, the slide 102 is moved distally into the nominal, default slide-forward position by the recoil spring 104. The distal movement of the slide 102 seats (shown by the arrow S) a cartridge 130 in the chamber 128 of the handgun 100. As such, the handgun 100 may be cycled utilizing only one hand of the authorized user to place the handgun 100 in an operational configuration.

In some embodiments, the motive assembly 2400 may also be configured to serve as the lock mechanism 2200. In other words, the motive assembly 2400 may be configured to both generate the motive force ($F_M$) and to restrict the movement of the engagement member 2100 from the lock position ($L_P$). For example, in some embodiments, the motive assembly 2400 may include a stepper motor (not shown) and a lead screw (not shown) to which the engagement member 2100 is coupled. The stepper motor may be employed to hold the engagement member 2100 in the lock position ($L_P$) by maintaining the lead screw in a fixed rotational position.

In some embodiments, the safety system 2000 includes a housing 2500. The housing 2500 provides the structure for support and mounting of the safety system 2000 to the handgun 100. The housing 2500 is formed from materials having sufficient strength to prevent access to internal components of the safety system 2000. For example, in various embodiments, the housing 2500 is formed from a metal, a reinforced plastic, and/or composite. In some embodiments, the housing 2500 is the unitary structure defining at least one internal cavity. In other embodiments, the housing 2500 is formed by the coupling of multiple housing members that are separately formed. For example, the housing 2500 may be formed at least from a first housing half and a second housing half.

As depicted in FIGS. 5 and 6, the housing 2500 supports the user interface 2300. For example, the housing 2500 may define an external recess in which the user interface 2300 may be secured. The housing 2500 includes a coupling portion 2510. The coupling portion 2510 is configured to receive a portion of the handgun 100, such as the mounting structure 116. In other words, the housing 2500, and thus the safety system 2000, may be fixedly coupled to the handgun 100 via an interface between the coupling portion 2510 and the mounting structure 116. The housing 2500 may, for example, be coupled to the handgun 100 and a position that is forward of the trigger guard 114. As depicted in FIGS. 3 and 4 the positioning of safety system 2000, in some embodiments, establishes a spacing between the housing 2500 and the trigger guard 114. However, in some embodiments, the housing 2500 is formed to conform with a portion of the trigger guard 114 and is positioned in contact therewith.

In some embodiments, the housing 2500 also defines a lock cavity 2520 supporting at least a portion of the lock mechanism 2200. The lock cavity 2520 may, for example, be defined by an inner face of the housing 2500. Additionally, the housing 2500 defines an interface orifice (not shown). The interface orifice is oriented to facilitate the operable coupling of the engagement member 2100 to the lock mechanism 2200. The interface orifice may, for example, correspond to a slot or hole through which a portion of the engagement member 2100 may be inserted. The interface orifice is sized to facilitate a desired degree of travel of the engagement member 2100.

Figure 7:
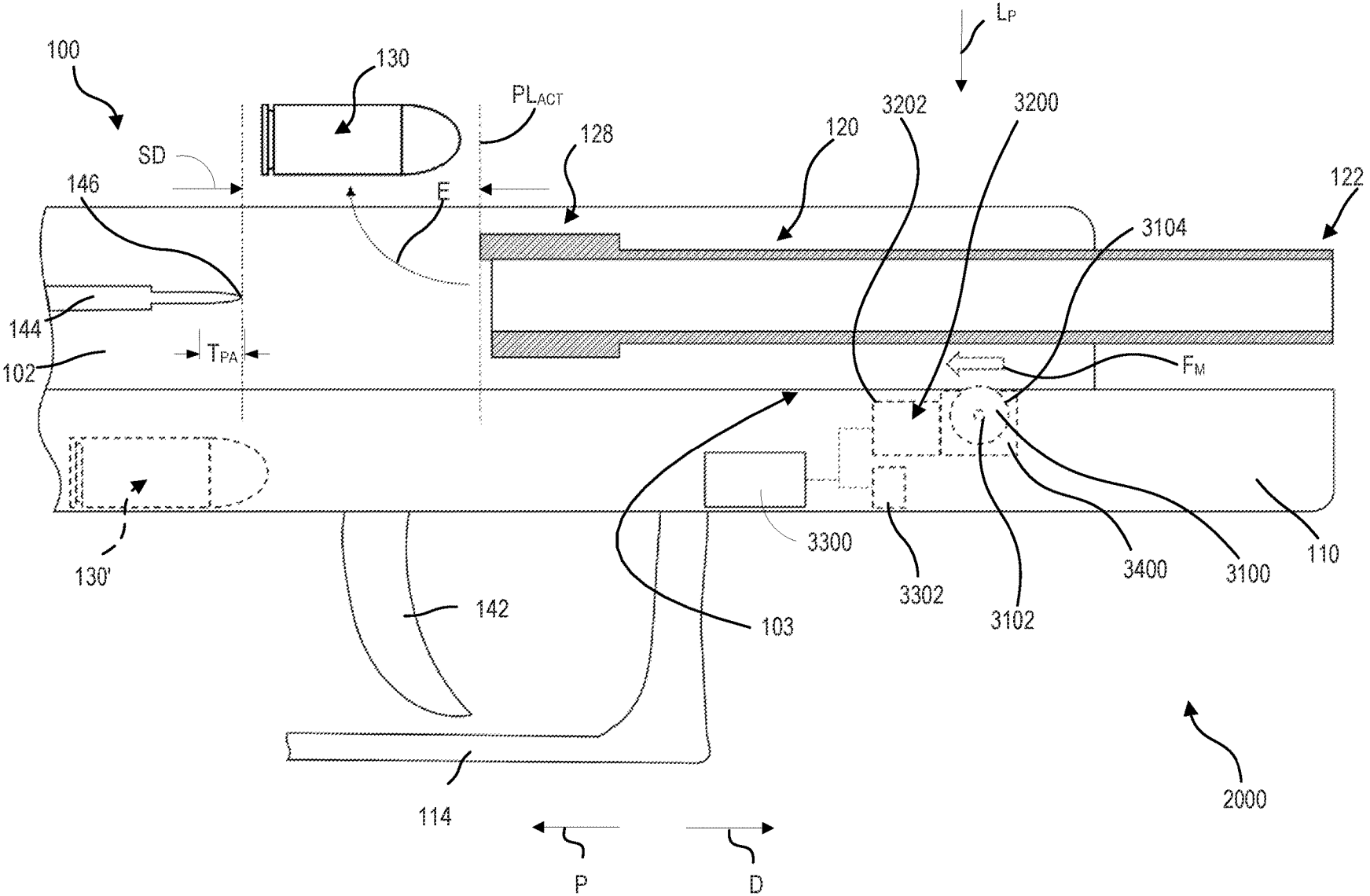
FIG. 7 is a diagrammatic illustration of an embodiment of the safety system positioned within the frame of the handgun, particularly illustrating the ejecting of a cartridge via the safety system during a transition to a locked configuration.

Although the safety system 1000 and the safety system 2000 are shown as including a separate housing that contains the components of the safety system and is mounted to the handgun 100, in other embodiments, any of the safety system components described herein can be integrated within a handgun. For example, FIG. 7 is a diagrammatic illustration of a safety system 3000 for a handgun 100. As described for previous embodiments, in some embodiments the safety system 3000 develops a forced malfunction of the handgun 100 that precludes the handgun 100 from discharging when the safety system 3000 is in a locked configuration. In some embodiments, the safety system 3000 is integrated into a newly manufactured handgun 100. Although shown and described as being integrated with the handgun 100, the safety system 3000 can be coupled to and/or used with any suitable firearm.

In FIG. 7, the safety system 3000 is depicted in a locked configuration. The safety system 3000 includes an engagement member 3100, a lock mechanism 3200, a user interface 3300, and, optionally, a motive assembly 3400. As described in more detail below, the safety system 3000 can allow the handgun 100 to be selectively locked (or placed in a safe, "no-fire" condition) and unlocked while remaining integrated with the handgun 100. The engagement member 3100 is movably coupled to the handgun 100 and includes an actuator portion 3102 and a contact face 3104. In other words, the engagement member 3100 may, in various embodiments, be configured to move/translate (e.g., rotate) relative to the frame 110 in accordance with the locked/unlocked configuration of the safety system 3000. The movement/translation of the engagement member 3100 is the result of a motive force ($F_M$) received by the actuator portion 3102 of the engagement member 3100. For example, in some embodiments the actuator portion 3102 is operably coupled to receive the motive force $F_M$ from a motive assembly 3400.

As depicted in FIG. 7, the engagement member 3100 includes the contact face 3104 that is configured to contact a portion of the slide 102. Thus, in certain operational conditions, movement of the engagement member 3100 can produce movement of the slide 102. In other operational conditions, the contact between contact face 3104 and the slide 102 can limit movement of the slide 102. In some embodiments, the contact between the contact face 3104 and the portions slide 102 facilitates the transfer of a portion of the motive force ($F_M$) to the slide 102 in a proximal direction (P).

In some embodiments, the engagement member 3100 is positioned at least partially between the slide 102 and the frame 110 of the handgun. In such embodiments, the engagement member 3100 is oriented to engage a bottom face 103 of the slide 102. For example, in some embodiments, the engagement member 3100 is a toothed wheel positioned to engage a corresponding toothed portion of the slide 102.

As described for previous embodiments, in some embodiments the engagement member 3100 is configured to move relative to the frame 110 between a lock position ($L_P$) (as depicted in FIG. 7) and an unlock position (not shown). In some embodiments, the engagement member 3100 is configured to transition between the lock position ($L_P$) and the unlock position while remaining movably coupled to the handgun 100. In other words, in some embodiments, the engagement member 3100 (and the safety system 3000) remains coupled to the handgun 100 when transitioned between the lock and unlock positions. For example, in some embodiments the engagement member 3100, is configured to rotate between the lock position ($L_P$) and the unlock position. The lock position ($L_P$) corresponds to a separation distance (SD) between the distal end 146 of the primer actuator 144 of the handgun 100 and a primer activation plane ($PL_{ACT}$) of the handgun 100. In other words, the movement of the slide 102 (and the resultant longitudinal movement of the supported primer actuator 144) in response to the portion of the motive force ($F_M$) transferred by the engagement member 3100 transitioning to the lock position ($L_P$) establishes the separation distance (SD). Said another way, the proximal movement of the slide 102 results in a proximal shift of the nominal range of travel ($T_{PA}$) of the primer actuator 144 relative to the frame 110, and thus the barrel 120.

The separation distance (SD) has a magnitude that precludes contact between the distal end 146 of the primer actuator 144 (e.g., the firing pin) and the primer 136 of a chambered cartridge 130 even if the firing mechanism 140 is actuated. Said another way, the magnitude of the separation distance (SD) is such that the point of maximal distal travel (e.g., the distal limit of the nominal range of travel ($T_{PA}$)) is proximal to, and separated from, the primer activation plane ($PL_{ACT}$). Insofar as the separation distance (SD) precludes any contact between the primer actuator 144 and the primer 136, the handgun 100 is rendered inoperable (e.g., made safe) so long as the separation distance (SD) is maintained.

The primer activation plane ($PL_{ACT}$) is a plane orthogonal to the longitudinal axis (L) of the handgun 100. The primer activation plane ($PL_{ACT}$) corresponds to the nominal longitudinal position at which a proximal face of the primer 136 would lie if/when a cartridge 130 were/is seated in the chamber 128. In other words, the primer activation plane ($PL_{ACT}$) corresponds to the longitudinal position at which the distal end 146 would first contact the primer 136 during the discharging of the handgun 100. In some embodiments, the primer activation plane ($PL_{ACT}$) may be congruent with a plane defined by a maximal proximal portion of the chamber end 124 of the barrel 120.

In some embodiments, the lock position ($L_P$) corresponds to a fully-retracted position of the slide 102. In other words, when the engagement member 3100 is in the lock position ($L_P$), the slide 102 is at a point of maximal proximal travel (e.g., in contact with a proximal stop). Said another way, in some embodiments, when the engagement member 3100 is in the lock position ($L_P$), the slide 102 is to the rear. The lock position ($L_P$) corresponding to the fully-retracted position of the slide 102 also corresponds to a maximal separation distance (SD) between the distal end 146 of the primer actuator 144 of the handgun 100 and the primer activation plane ($PL_{ACT}$) of the handgun 100.

As depicted in FIG. 7, in some embodiments, the movement of the slide 102 in the proximal direction in response to the motive force ($F_M$) applied via the engagement member 3100 ejects (E) a cartridge 130 from the chamber 128 of the barrel 120. In other words, when the safety system 3000 is actuated to make safe the handgun 100, the transition of the engagement member 3100 to the lock position ($L_P$) facilitates the ejecting (shown by the arrow E) of a chambered cartridge 130. The cartridge 130 is the ejected (E) via an ejector mechanism (not shown) of the handgun 100. It should be appreciated that ejecting (E) the cartridge 130 during the making safe of the handgun 100 may facilitate the storage of the handgun 100 with an empty chamber 128.

The unlock position corresponds to a nominal position (similar to the nominal position $P_N$ shown in FIG. 3) of the distal end 146 of the primer actuator 144 along the nominal range of travel ($T_{P4}$). The nominal position may be proximal to the primer activation plane ($PL_{ACT}$) such that a nominal clearance exists between the distal end 146 and the primer 136. In some embodiments, the nominal position corresponds to the longitudinal position of the distal end 146 when the handgun 100 is in an uncocked state with the slide 102 in the default, slide-forward position. However, in additional embodiments, the nominal position corresponds to the nominal longitudinal position of the distal end 146 when the handgun 100 is in a half-cocked state or a cocked (e.g., fully cocked) state with the slide 102 in the default, slide-forward position. In other words, when the engagement member 3100 is in the unlock position, the handgun 100 may be in an operational state/condition from which the handgun 100 may be discharged to engage a target.

In some embodiments transitioning the engagement member 3100 from the lock position ($L_P$) to the unlock position facilitates a distal movement (not shown) of the slide 102. In other words, the transition (e.g., the linear movement) of the engagement member 3100 to the unlock position ($U_P$) may remove a restriction on the longitudinal movement (e.g., movement in the distal direction relative to the frame 110) of the slide 102, thereby allowing the slide 102 to return to the nominal, default slide-forward position (as depicted in FIG. 1) in response to the force applied via the recoil spring 104.

In some embodiments, the distal movement of the slide 102 seats (S) a cartridge 130 in the chamber 128 of the handgun 100. For example, unlocking of the safety system 3000 permits the transition of the engagement member 3100 from the lock position ($L_P$). This transition allows the slide 102 to move distally. In accordance with the nominal operation of the handgun 100, the distal movement of the slide 102 strips a cartridge 130' from a loaded magazine (not shown) inserted in the handgun 100 and seats the cartridge 130 in the chamber 128. In other words, in some embodiments, the unlocking of the safety system 3000 results in the chambering of a cartridge 130 (e.g., seating a cartridge 130 in the chamber 128) and the placing of the handgun 100 in an operational state, from which the handgun 100 may be discharged/employed.

In some embodiments, the safety system 3000 includes the lock mechanism 3200, which is operably coupled to the engagement member 3100. As depicted in FIG. 7, the lock mechanism 3200 is positioned within a cavity 3202 defined at least partially by the frame 110 of the handgun 100. The lock mechanism 3200 is positioned to restrict the movement of the engagement member 3100 from the locked position ($L_P$) while the lock mechanism is engaged. In other words, the lock mechanism 3200 maintains the engagement member 3100 (and therefore the engaged slide 102) in a fixed position (e.g., the position ($L_P$)) relative to the frame 110. In some embodiments, the lock mechanism 3200 may be a mechanical lock mechanism wherein the lock mechanism 3200 mechanically engages a portion of the engagement member 3100, such as via at least one pin, a catch, a locking bar, a cam, and/or other suitable structure. In some embodiments, the lock mechanism 2200 may utilize a magnetic force to restrict the movement of the engagement member 3100. For example, the lock mechanism 3200 may be configured to magnetically engage the engagement member 3100 directly or may utilize a magnetic field to restrict the rotation of the actuator portion 3102 of the engagement member 3100.

As further depicted in FIG. 7, the safety system 3000 includes the user interface 3300, which is operably coupled to the lock mechanism 3200. The user interface 3300 is configured to transition the lock mechanism 3200 between an engaged state and a disengaged state. In other words, the user interface 3300 is employed by an authorized user to facilitate the movement of the engagement member 3100 between the lock position ($L_P$) and the unlock position by locking or unlocking the lock mechanism 3200. Once unlocked, the safety system 3000 remains unlocked until the locking mechanism 3200 is affirmatively reengaged by an operator.

The user interface 3300 may include a biometric user identification (e.g., fingerprint identification) unit, a radio frequency identification reader, a numerical input apparatus, a microphone, a magnetic key, a mechanical key, and/or other input system configured to authenticate an authorized user. For example, the user interface 3300 may, in some embodiments, include a fingerprint sensor operably coupled to a biometric processor and a data storage device containing stored identification data for authorized users. The fingerprint sensor may be an optical sensor, a thermal sensor, and/or a pressure sensor and may be configured as a static sensor or a swipe sensor. Additionally, in some embodiments the user interface 3300 includes a wireless communication unit that facilitates the remote operation of the safety system 3000 via a wireless network, a cellular network, and/or a Bluetooth connection.

In some embodiments, a GPS module 3302 is operably coupled to the user interface 3300. The GPS module 3302 facilitates position tracking of the handgun 100 via the safety system 3000 coupled thereto. For example, the GPS module 3302 may the employed in conjunction with a geo-fence (e.g., a region with boundaries that are defined by GPS coordinates). In some embodiments an embodiment, an authorized user of the handgun 100 may be alerted in the event the handgun 100 departs the geo-fence. In additional embodiments, the user interface 3300 may be disabled upon the departure of the handgun 100 from the geo-fence. In further embodiments, the user interface 3300 may be configured to transition the lock mechanism 3200 to, or maintain the lock mechanism 3200 in, the engaged state following the departure of the handgun 100 from the geo-fence.

As depicted in FIG. 7, in some embodiments the safety system 3000 includes a motive assembly 3400. The motive assembly 3400 is operably coupled to the actuator portion 3102 of the engagement member 3100. The motive assembly 3400 is configured to generate the motive force ($F_M$). In some embodiments, the motive force ($F_M$) is generated in response to a user input, such as may be received via the user interface 3300. The motive assembly 3400 may, for example, include a motor assembly, a pneumatic assembly, and/or a spring assembly configured to generate the motive force ($F_M$). In other words, the motive assembly 3400 includes a mechanism that transforms thermal, chemical, electrical, pressure, or any other source of energy into the mechanical energy represented by the motive force ($F_M$).

In some embodiments, the safety system 3000, via the motive assembly 3400, may facilitate the single-handed chambering of a cartridge 130 and/or clearing of a malfunction of the handgun 100 via the cycling of the handgun 100. More specifically, the handgun 100 may be maintained in a deployed orientation (e.g., with the muzzle 122 pointed downrange) in the hand of an authorized user while the authorized user actuates the unlocked safety system 3000. The authorized user may actuate the safety system 3000 via an engagement of the user interface 3300 with a portion (e.g., a finger) of the same hand holding the handgun 100. Upon actuation, the motive assembly 3400 may drive the engagement member 3100, and thus the slide 102, proximally (e.g., rearward). The proximal motion of the engagement member 3100 and the slide 102 may continue until the slide 102 encounters a slide stop. The proximal motion of the slide 102 may eject any chambered, misfed, or jammed cartridge 130. Once the slide 102 has moved proximally a maximal distance, the authorized user may unlock the safety system 3000 via an engagement of the user interface 3300 with the portion of the same hand holding the handgun 100. The user interface 3300 may be engaged by the portion of the hand of the authorized users while continuing to maintain the handgun 100 in the deployed orientation. With the safety system 3000 unlocked, the slide 102 is moved distally into the nominal, default slide-forward position by the recoil spring 104. The distal movement of the slide 102 seats a cartridge 130 in the chamber 128 of the handgun 100. As such, the handgun 100 may be cycled utilizing only one hand of the authorized user to place the handgun 100 in an operational configuration.

In some embodiments, the motive assembly 3400 may also be configured to serve as the lock mechanism 3200. In other words, the motive assembly 3400 may be configured to both generate the motive force ($F_M$) and to restrict the movement of the engagement member 3100 from the lock position ($L_P$). For example, in some embodiments, the motive assembly 3400 may include a stepper motor (not shown) and a lead screw (not shown) to which the engagement member 3100 is coupled. The stepper motor may be employed to hold the engagement member 3100 in the lock position ($L_P$) by maintaining the lead screw in a fixed rotational position.

Figure 8:
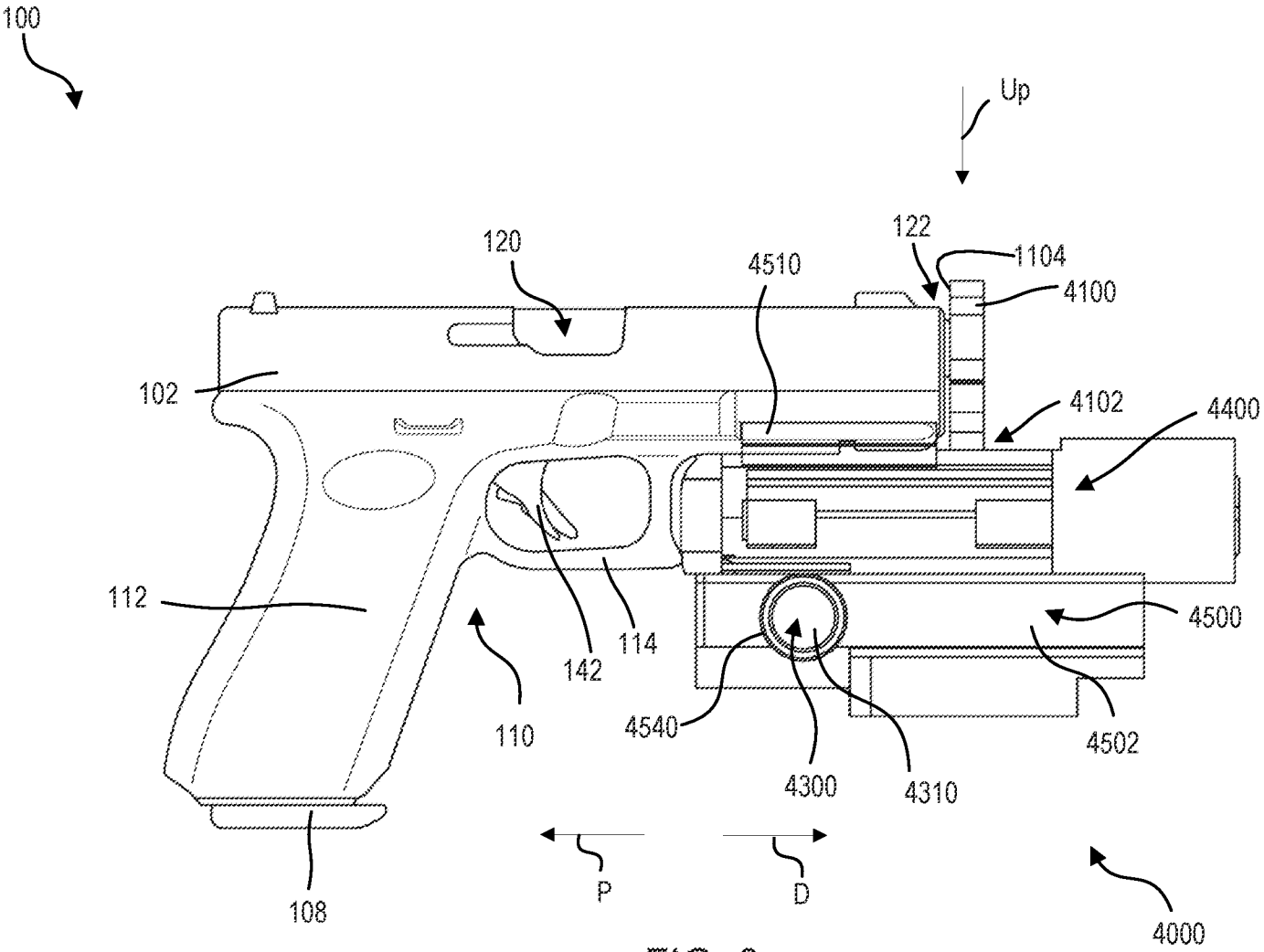
FIGS. 8 and 9 depict side views of an embodiment of a safety system coupled to the handgun of FIG. 1, with the safety system being depicted in an unlocked configuration.
Figure 9:
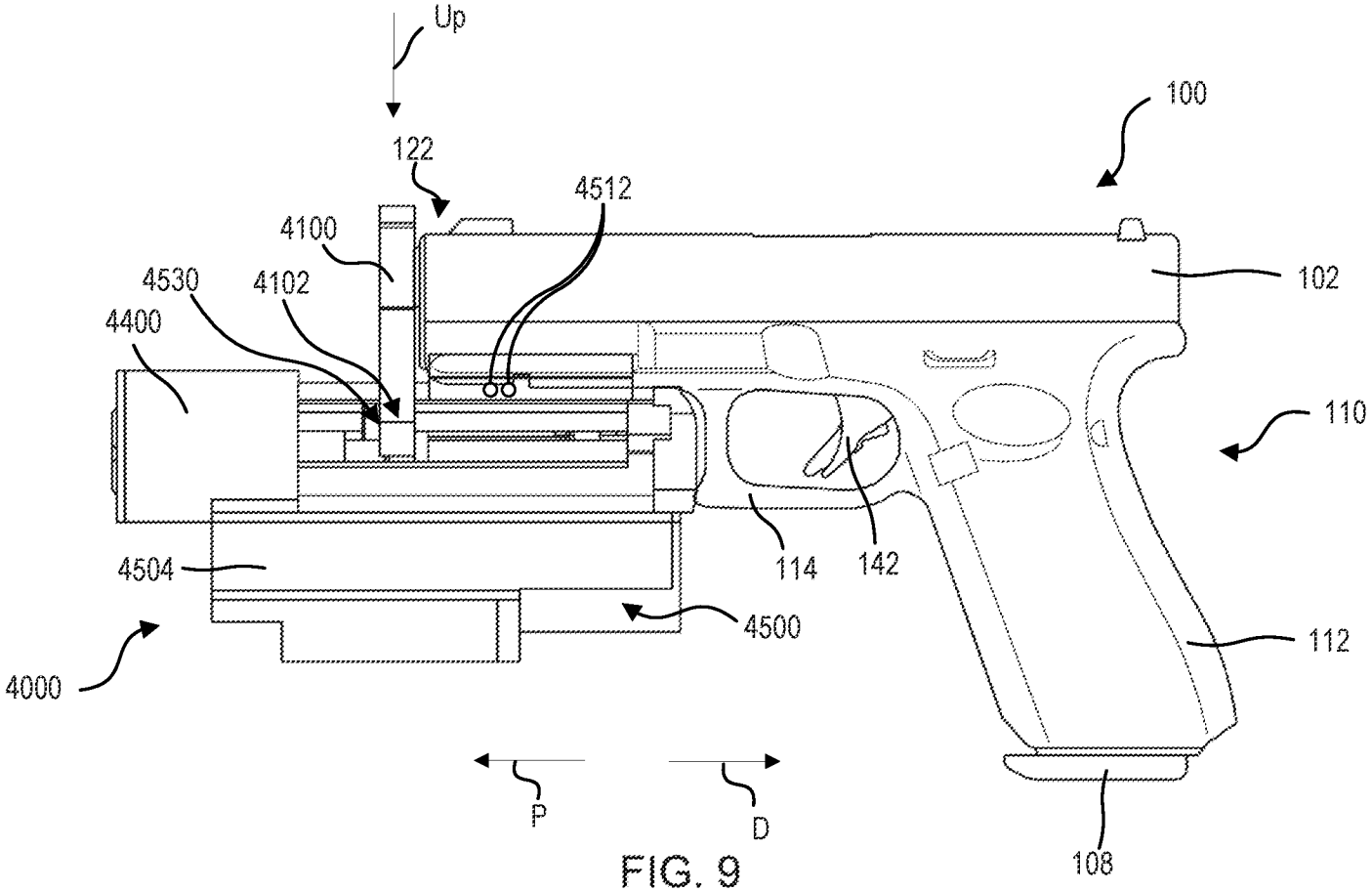
Figure 10:
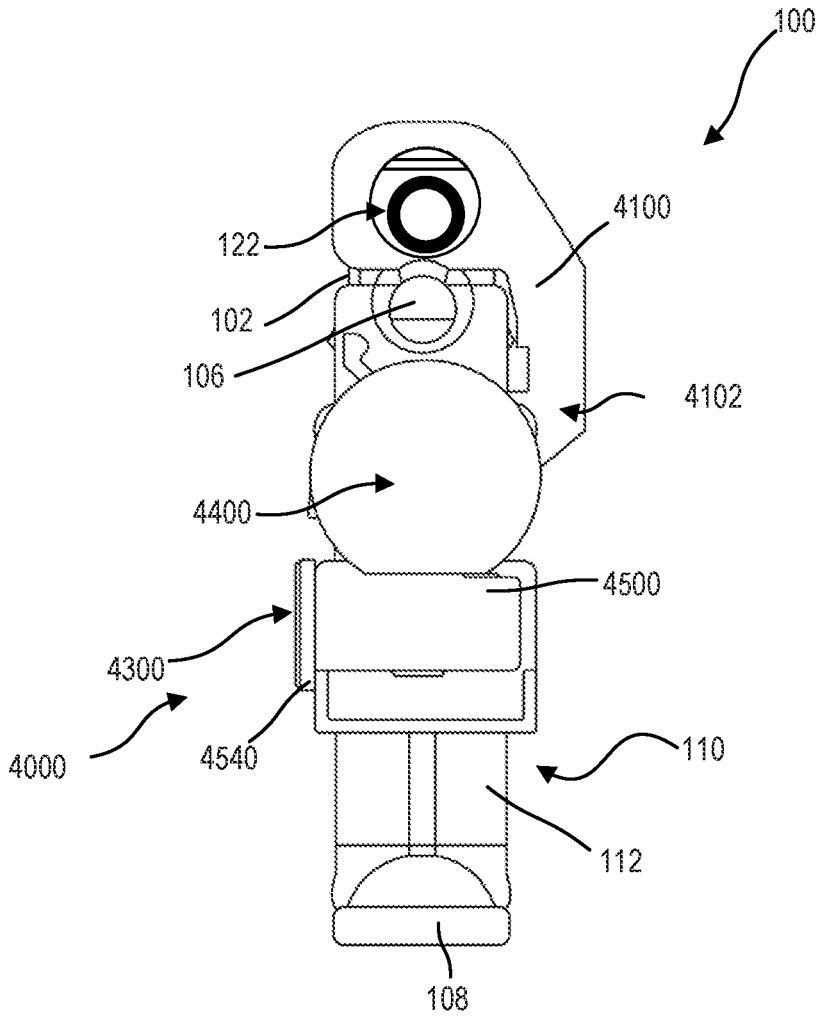
FIG. 10 depicts a front view of an embodiment of safety system of FIGS. 8 and 9 coupled to the handgun of FIG. 1.
Figure 11:
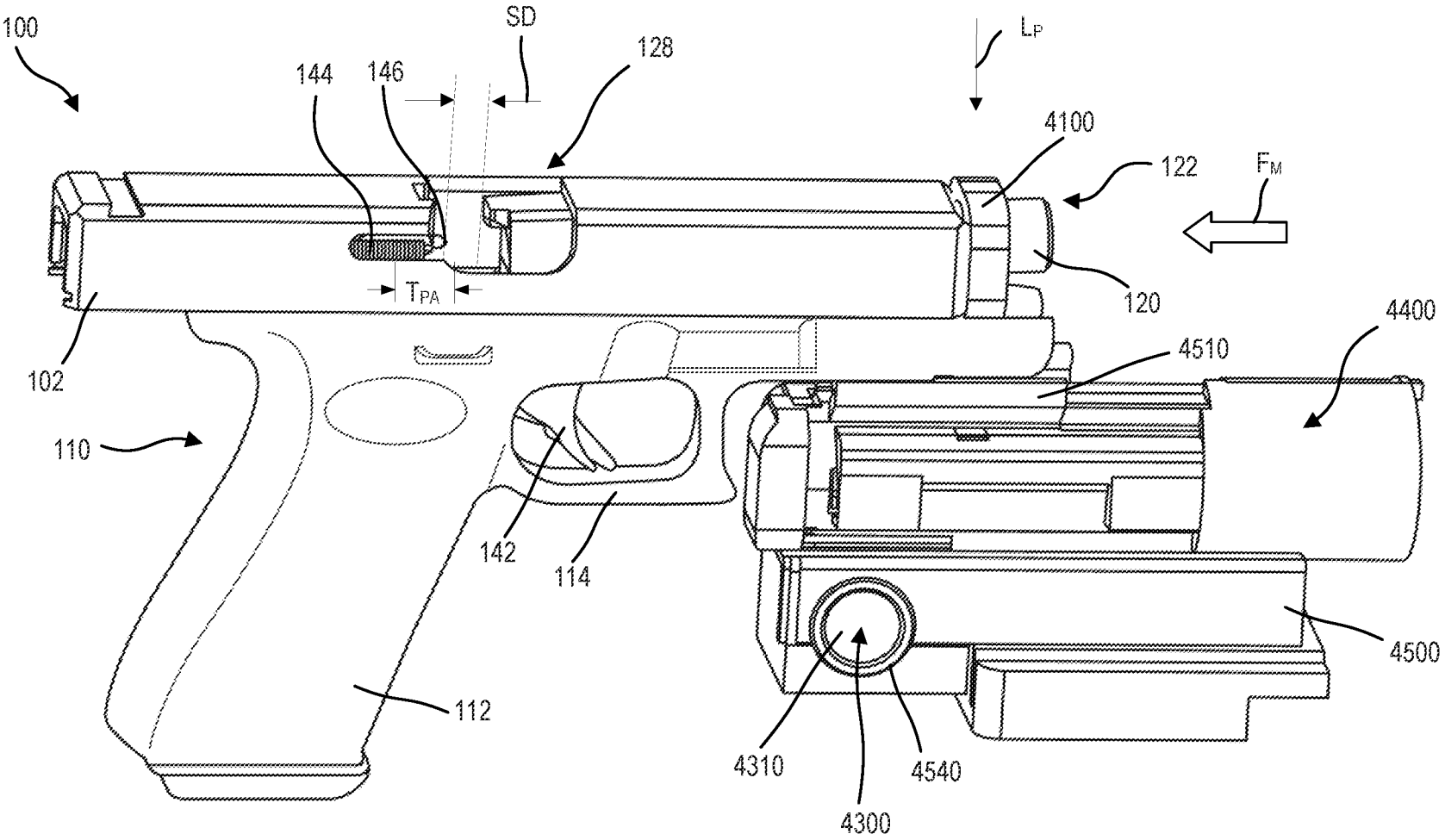
FIG. 11 depicts a perspective view of an embodiment of the safety system of FIGS. 8-10 coupled to the handgun of FIG. 1, with the safety system being depicted in a locked configuration.
Figure 12:
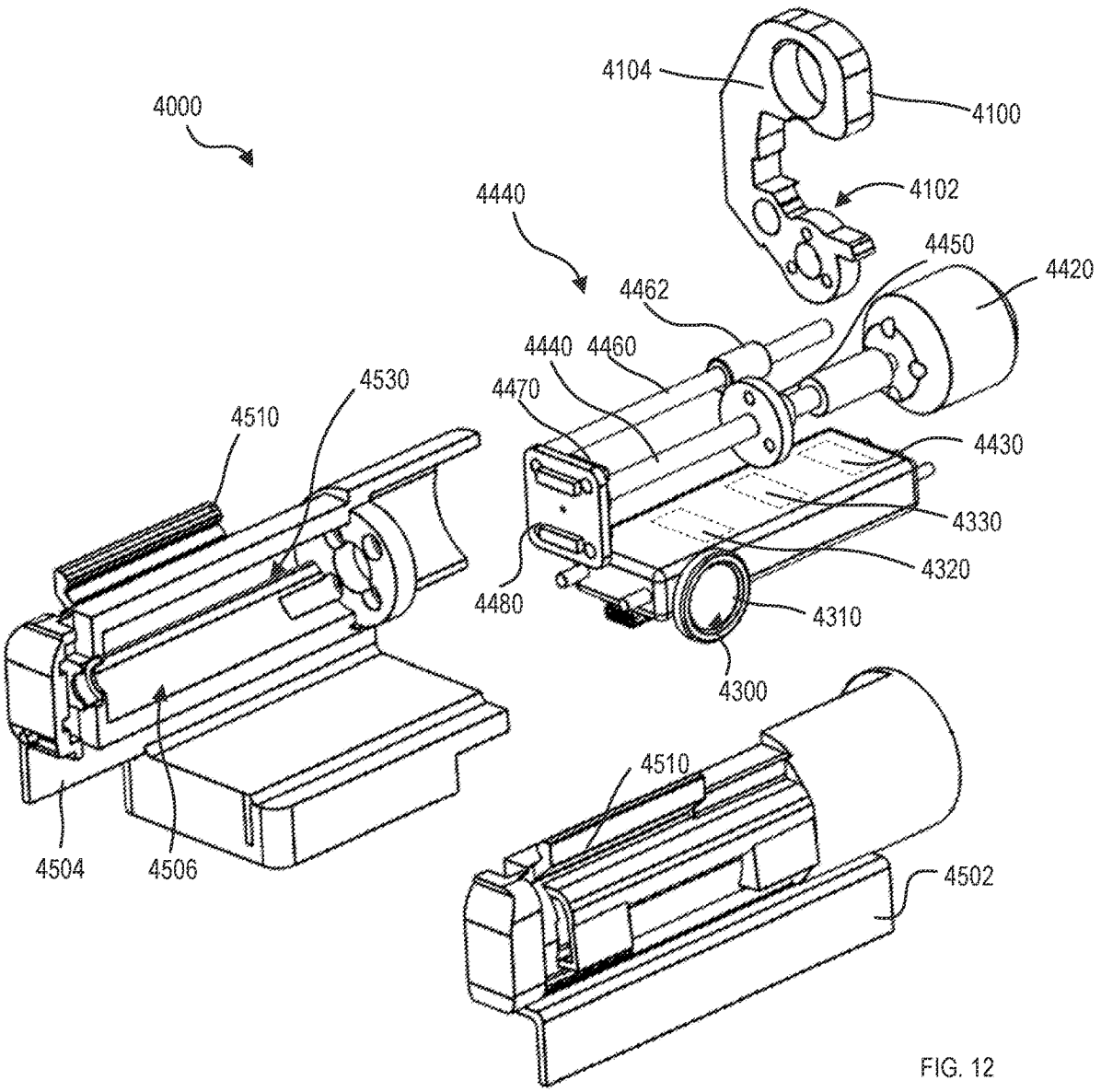
FIG. 12 depicts an exploded perspective view of the safety system of FIGS. 8-11.

FIGS. 8 and 9 depict side views of an embodiment of a safety system 4000 coupled to a portion of the handgun 100. FIG. 10 depicts a front view of an embodiment of the safety system 4000 coupled to a portion of the handgun 100. In FIGS. 8-10, the safety system 4000 is depicted in an unlocked configuration. FIG. 11 depicts a perspective view of an embodiment of the safety system 4000 coupled to the handgun 100, with the safety system 4000 being depicted in a locked configuration. Additionally, FIG. 12 depicts an exploded perspective view of the safety system 4000. As described for previous embodiments, in some embodiments the safety system 4000 develops a forced malfunction of the handgun 100 that precludes the handgun 100 from discharging when the safety system 4000 is in a locked configuration. In some embodiments, the safety system 4000 is coupled to an existing handgun 100 as depicted in FIGS. 8-11. Although shown and described as being coupled to the handgun 100, the safety system 4000 can be coupled to and/or used with any suitable firearm.

In FIGS. 8-10, the safety system 4000 is depicted in an unlocked configuration, while in FIG. 11, the safety system 4000 is depicted in an unlocked configuration. The safety system 4000 includes an engagement member 4100, a lock mechanism 4200, a user interface 4300, and a motive assembly 4400. As described in more detail below, the safety system 4000 can allow the handgun 100 to be selectively locked (or placed in a safe, "no-fire" condition) and unlocked while remaining coupled to the handgun 100. The engagement member 4100 is movably coupled to the handgun 100 and includes an actuator portion 4102 and a contact face 4104. In other words, the engagement member 4100 may, in various embodiments, be configured to move/translate (e.g., slide, rotate, pivot, and/or tilt) relative to the frame 110 in accordance with the locked/unlocked configuration of the safety system 4000. The movement/translation of the engagement member 4100 is the result of a motive force ($F_M$) received by the actuator portion 4102 of the engagement member 4100. For example, in some embodiments the actuator portion 4102 is operably coupled to receive the motive force $F_M$ from a motive assembly 4400.

In some embodiments, the engagement member 4100 includes the contact face 4104 that is configured to contact a portion of the slide 102. Thus, in certain operational conditions, movement of the engagement member 4100 can produce movement of the slide 102. In other operational conditions, the contact between contact face 4104 and the slide 102 can limit movement of the slide 102. In some embodiments, a clearance may be established between the contact face 4104 and the portion of the slide 102 when the safety system 4000 is in the unlocked configuration. Similarly stated, the contact face 4104 can be spaced apart from the slide 102 when the safety system 4000 is in the unlocked configuration. In some embodiments, the contact between the contact face 4104 and the portions slide 102 facilitates the transfer of a portion of the motive force ($F_M$) to the slide 102 in a proximal direction (P).

As described for previous embodiments, in some embodiments the engagement member 4100 is configured to move relative to the frame 110 between a lock position ($L_P$) (as depicted in FIG. 11) and an unlock position ($U_P$) (as depicted in FIGS. 8 and 9). In some embodiments, the engagement member 4100 is configured to transition between the lock position ($L_P$) and the unlock position ($U_P$) while remaining movably coupled to the handgun 100. In other words, in some embodiments, the engagement member 4100 (and the safety system 4000) remains coupled to the handgun 100 when transitioned between the lock and unlock positions. For example, in some embodiments the engagement member 4100, is configured to move linearly between the lock position ($L_P$) and the unlock position ($U_P$). The lock position ($L_P$) corresponds to a separation distance (SD) between the distal end 146 of the primer actuator 144 of the handgun 100 and a primer activation plane ($PL_{ACT}$) of the handgun 100. In other words, the movement of the slide 102 (and the resultant longitudinal movement of the supported primer actuator 144) in response to the portion of the motive force ($F_M$) transferred by the engagement member 4100 transitioning to the lock position ($L_P$) establishes the separation distance (SD). Said another way, the proximal movement of the slide 102 results in a proximal shift of the nominal range of travel ($T_{PA}$) of the primer actuator 144 relative to the frame 110, and thus the barrel 120.

As depicted in FIG. 11. the separation distance (SD) has a magnitude that precludes contact between the distal end 146 of the primer actuator 144 (e.g., the firing pin) and the primer 136 of a chambered cartridge 130 even if the firing mechanism 140 is actuated. Said another way, the magnitude of the separation distance (SD) is such that the point of maximal distal travel (e.g., the distal limit of the nominal range of travel ($T_{PA}$)) is proximal to, and separated from, the primer activation plane ($PL_{ACT}$). Insofar as the separation distance (SD) precludes any contact between the primer actuator 144 and the primer 136, the handgun 100 is rendered inoperable (e.g., made safe) so long as the separation distance (SD) is maintained.

The primer activation plane ($PL_{ACT}$) is a plane orthogonal to the longitudinal axis (L) of the handgun 100. The primer activation plane ($PL_{ACT}$) corresponds to the nominal longitudinal position at which a proximal face of the primer 136 would lie if/when a cartridge 130 were/is seated in the chamber 128. In other words, the primer activation plane ($PL_{ACT}$) corresponds to the longitudinal position at which the distal end 146 would first contact the primer 136 during the discharging of the handgun 100. In some embodiments, the primer activation plane ($PL_{ACT}$) may be congruent with a plane defined by a maximal proximal portion of the chamber end 124 of the barrel 120.

In some embodiments, the lock position ($L_P$) corresponds to a fully-retracted position of the slide 102. In other words, when the engagement member 4100 is in the lock position ($L_P$), the slide 102 is at a point of maximal proximal travel (e.g., in contact with a proximal stop). Said another way, in some embodiments, when the engagement member 4100 is in the lock position ($L_P$), the slide 102 is to the rear. The lock position ($L_P$) corresponding to the fully-retracted position of the slide 102 also corresponds to a maximal separation distance (SD) between the distal end 146 of the primer actuator 144 of the handgun 100 and the primer activation plane ($PL_{ACT}$) of the handgun 100.

In some embodiments, the movement of the slide 102 in the proximal direction in response to the motive force ($F_M$) applied via the engagement member 4100 ejects a cartridge 130 from the chamber 128 of the barrel 120. In other words, when the safety system 4000 is actuated to make safe the handgun 100, the transition of the engagement member 4100 to the lock position ($L_P$) (e.g., the proximal movement of the engagement member 4100) facilitates the ejecting of a chambered cartridge 130. The cartridge 130 is the ejected via an ejector mechanism (not shown) of the handgun 100. It should be appreciated that ejecting the cartridge 130 during the making safe of the handgun 100 may facilitate the storage of the handgun 100 with an empty chamber 128.

The unlock position ($U_P$) corresponds to a nominal position (similar to the nominal position $P_N$ shown in FIG. 3) of the distal end 146 of the primer actuator 144 along the nominal range of travel ($T_{PA}$). The nominal position may be proximal to the primer activation plane ($PL_{ACT}$) such that a nominal clearance exists between the distal end 146 and the primer 136. In some embodiments, the nominal position corresponds to the longitudinal position of the distal end 146 when the handgun 100 is in an uncocked state with the slide 102 in the default, slide-forward position. However, in additional embodiments, the nominal position corresponds to the nominal longitudinal position of the distal end 146 when the handgun 100 is in a half-cocked state or a cocked (e.g., fully cocked) state with the slide 102 in the default, slide-forward position. In other words, when the engagement member 2100 is in the unlock position ($U_P$), the handgun 100 may be in an operational state/condition from which the handgun 100 may be discharged to engage a target.

In some embodiments transitioning the engagement member 4100 from the lock position ($L_P$) to the unlock position ($U_P$) facilitates a distal movement of the slide 102. In other words, the transition (e.g., the linear movement) of the engagement member 4100 to the unlock position ($U_P$) may remove a restriction on the longitudinal movement (e.g., movement in the distal direction relative to the frame 110) of the slide 102, thereby allowing the slide 102 to return to the nominal, default slide-forward position (as depicted in FIG. 1) in response to the force applied via the recoil spring 104.

In some embodiments, the distal movement of the slide 102 seats a cartridge 130 in the chamber 128 of the handgun 100. For example, unlocking of the safety system 4000 permits the transition of the engagement member 4100 from the lock position ($L_P$) to the unlock position ($U_P$). This transition allows the slide 102 to move distally. In accordance with the nominal operation of the handgun 100, the distal movement of the slide 102 strips a cartridge 130' from a loaded magazine (not shown) inserted in the handgun 100 and seats the cartridge 130' in the chamber 128. In other words, in some embodiments, the unlocking of the safety system 4000 results in the chambering of a cartridge 130 (e.g., seating a cartridge 130' in the chamber 128) and the placing of the handgun 100 in an operational state, from which the handgun 100 may be discharged/employed.

As depicted, in some embodiments the safety system 4000 includes a motive assembly 4400. The motive assembly 4400 is operably coupled to the actuator portion 4102 of the engagement member 4100. The motive assembly 4400 is configured to generate the motive force ($F_M$). In some embodiments, the motive force ($F_M$) is generated in response to a user input, such as may be received via the user interface 4300. As depicted in FIG. 12, the motive assembly 4400 includes a motor 4420, a lead screw 4440, and a limit switch 4470 and/or a magnetic encoder 4480. The motor 4420 may, for example, be a stepper motor, a servo motor, a linear motor, and/or a brushless motor configured to generate a motive force ($F_M$) that is greater than a force exerted on the slide 102 by the recoil spring 104. The motor 4420 is operably coupled to an energy storage device 4430, such as a battery and/or a capacitor, and the user interface 4300.

The lead screw 4440 is rotatable by the motor 4420. As depicted, the lead screw 4440 is axially aligned with the motor 4420. However, in some embodiments, the lead screw 4440 is rotatable by the motor 4420 via a gearing assembly (not shown) and may the axially offset from the motor 4420. The lead screw 4440 is configured to convert a rotational input from the motor 4420 into a linear motion of the engagement member 4100. For example, in some embodiments, the engagement member 4100 is coupled to a drive nut 4450 that circumscribes the lead screw 4440. The drive nut 4450 is formed with threads that correspond to the threads of the lead screw 4440 such that the rotation of the lead screw 4440 results in a linear motion of the drive nut 4450. In order to prevent the rotation of the drive nut 4450, in some embodiments, the engagement member 4100 is also slidingly coupled to a guide shaft 4460 via a linear bearing 4462.

As further depicted in FIG. 12, in some embodiments, the limit switch 4470 and the magnetic encoder 4480 are coupled at the opposite end of the lead screw 4440 from the motor 4420. The limit switch 4470 is configured to terminate the generation of the motive force ($F_M$) when contacted by the drive nut 4450 or the engagement member 4100. The magnetic encoder 4480 is configured to monitor rotations of the lead screw 4440. As the thread pitch of the lead screw 4440 is known, the magnetic encoder 4480 may facilitate the monitoring of the linear distance traveled by the engagement member 4100.

Although shown as including a motor assembly in other embodiments the motive assembly 4400 can include any suitable components or structure to move the engagement member 4100, such as a pneumatic assembly and/or a spring assembly. In other words, the motive assembly 4400 can include any suitable mechanism that transforms thermal, chemical, electrical, pressure, or any other source of energy into the mechanical energy represented by the motive force ($F_M$)

In some embodiments, the safety system 4000, via the motive assembly 4400, may facilitate the single-handed chambering of a cartridge 130 and/or clearing of a malfunction of the handgun 100 via the cycling of the handgun 100. More specifically, the handgun 100 may be maintained in a deployed orientation (e.g., with the muzzle 122 pointed downrange) in the hand of an authorized user while the authorized user actuates the unlocked safety system 4000. The authorized user may actuate the safety system 4000 via an engagement of the user interface 4300 with a portion (e.g., a finger) of the same hand holding the handgun 100. Upon actuation, the motive assembly 4400 may drive the engagement member 4100, and thus the slide 102, proximally (e.g., rearward). The proximal motion of the engagement member 4100 and the slide 102 may continue until the slide 102 encounters a slide stop. The proximal motion of the slide 102 may eject any chambered, misfed, or jammed cartridge 130. Once the slide 102 has moved proximally a maximal distance, the authorized user may unlock the safety system 4000 via an engagement of the user interface 4300 with the portion of the same hand holding the handgun 100. The user interface 4300 may be engaged by the portion of the hand of the authorized users while continuing to maintain the handgun 100 in the deployed orientation. With the safety system 4000 unlocked, the slide 102 is moved distally into the nominal, default slide-forward position by the recoil spring 104. The distal movement of the slide 102 seats a cartridge 130 in the chamber 128 of the handgun 100. As such, the handgun 100 may be cycled utilizing only one hand of the authorized user to place the handgun 100 in an operational configuration.

In some embodiments, the motive assembly 4400 may also be configured to serve as the lock mechanism 4200. In other words, the motive assembly 4400 may be configured to both generate the motive force ($F_M$) and to restrict the movement of the engagement member 4100 from the lock position ($L_P$). For example, in some embodiments, the motor 4420 is configured as a stepper motor that is coupled to the lead screw 4440. The motor 4420 may, thus, hold the engagement member 4100 in the lock position ($L_P$) by maintaining the lead screw 4440 in a specified, fixed rotational position until unlocked via the user interface 4300.

In some embodiments, the safety system 4000 includes a lock mechanism 4200 that is a component separate from the motive assembly 4400. In such an embodiment, the lock mechanism 4200 is operably coupled to the engagement member 4100. The lock mechanism 4200 is positioned to restrict the movement of the engagement member 4100 from the locked position ($L_P$) while the lock mechanism is engaged. In other words, the lock mechanism 4200 maintains the engagement member 4100 (and therefore the engaged slide 102) in a fixed position (e.g., the position ($L_P$)) relative to the frame 110. In some embodiments, the lock mechanism 4200 may be a mechanical lock mechanism wherein the lock mechanism 4200 mechanically engages a portion of the engagement member 4100, such as via at least one pin, a catch, a locking bar, a cam, and/or other suitable structure. In some embodiments, the lock mechanism 4200 may utilize a magnetic force to restrict the movement of the engagement member 4100. For example, the lock mechanism 4200 may be configured to magnetically engage the engagement member 4100.

In some embodiments, the safety system 4000 includes the user interface 4300, which is operably coupled to the lock mechanism 4200 and/or the motive assembly 4400. The user interface 4300 is configured to transition the lock mechanism 4200 and/or the motive assembly 4400 between an engaged state and a disengaged state. In other words, the user interface 4300 is employed by an authorized user to facilitate the movement of the engagement member 4100 between the lock position ($L_P$) and the unlock position ($U_P$) by locking or unlocking the lock mechanism 4200 and/or the motive assembly 4400. Once unlocked, the safety system 4000 remains unlocked until the locking mechanism 4200 and/or the motive assembly 4400 is affirmatively reengaged by an operator.

The user interface 4300 may include a biometric user identification (e.g., fingerprint identification) unit, a radio frequency identification reader, a numerical input apparatus, a microphone, a magnetic key, a mechanical key, and/or other input system configured to authenticate an authorized user. For example, the user interface 4300 may, in some embodiments, include a fingerprint sensor 4310 operably coupled to a biometric processor 4320 and a data storage device 4330 containing stored identification data for authorized users. The fingerprint sensor may be an optical sensor, a thermal sensor, and/or a pressure sensor and may be configured as a static sensor or a swipe sensor. The user interface 4300 may also be operably coupled to the energy storage device 4430. Additionally, in some embodiments the user interface 4300 includes a wireless communication unit that facilitates the remote operation of the safety system 4000 via a wireless network, a cellular network, and/or a Bluetooth connection.

In some embodiments, a GPS module (not shown) may be operably coupled to the user interface 4300. The GPS module facilitates position tracking of the handgun 100 via the safety system 4000 coupled thereto. For example, the GPS module may the employed in conjunction with a geo-fence (e.g., a region with boundaries that are defined by GPS coordinates). In some embodiments an embodiment, an authorized user of the handgun 100 may be alerted in the event the handgun 100 departs the geo-fence. In additional embodiments, the user interface 4300 may be disabled upon the departure of the handgun 100 from the geo-fence. In further embodiments, the user interface 4300 may be configured to transition the lock mechanism 4200 to, or maintain the lock mechanism 4200 and/or the motive assembly 4400 in, the engaged state following the departure of the handgun 100 from the geo-fence.

In some embodiments, the safety system 4000 includes a housing 4500. The housing 4500 provides the structure for support and mounting of the safety system 4000 to the handgun 100. The housing 4500 is formed from materials having sufficient strength to prevent access to internal components of the safety system 4000. For example, in various embodiments, the housing 4500 is formed from a metal, a reinforced plastic, and/or composite. In some embodiments, the housing 4500 is the unitary structure defining at least one internal cavity. In other embodiments, the housing 4500 is formed by the coupling of multiple housing members that are separately formed. For example, the housing 4500 may be formed at least from a first housing half 4502 and a second housing half 4504.

As depicted in FIGS. 8, 10, and 11, the housing 4500 supports the user interface 4300. For example, the housing 4500 may define an external recess 4540 in which the user interface 4300 may be secured. The housing 4500 also includes a coupling portion 4510. The coupling portion 4510 is configured to receive a portion of the handgun 100, such as the mounting structure 116. In other words, the housing 4500, and thus the safety system 4000, may be fixedly coupled to the handgun 100 via an interface between the coupling portion 4510 and the mounting structure 116. Although shown as being against or engaged with the trigger guard 114, in other embodiments, the housing 4500 may, for example, be coupled to the handgun 100 and a position that is forward of the trigger guard 114. For example the housing 4500 can be similar to the housing 1500 shown in FIGS. 3 and 4 and can establish a spacing between the housing 4500 and the trigger guard 114.

As depicted in FIG. 9, in some embodiments, safety system 4000 includes at least one fastener 4512. The fastener(s) 4512 is positioned adjacent the coupling portion 4510. For example, the fastener(s) 4512 may be inserted into a threaded passage defined by a portion of the coupling portion 4510. The fastener(s) 4512 is oriented to secure the mounting structure 116 of the handgun 100 within the coupling portion 4510. In some embodiments, the fastener(s) 4512 is at least partially occluded by a portion of the engagement member 4100 when the engagement member 4100 is in the lock position. As such, the engagement member 4100 preclude the loosening and/or removal of the fastener(s) 4512 while the safety system 4000 is in the locked configuration. Correspondingly, the transitioning of the engagement member 4100 to the unlock position ($U_P$) may permit access to the fastener(s) 4512 so that the safety system 4000 may be decoupled from the handgun 100 only when in the unlocked configuration.

In some embodiments, the housing 4500 also defines a lock cavity 4520 supporting at least a portion of the lock mechanism 4200. The lock cavity 4520 may, for example, be defined by an inner face 4506 of the housing 4500. Additionally, the housing 4500 defines an interface orifice 4530. The interface orifice 4530 is oriented to facilitate the operable coupling of the engagement member 4100 to the lock mechanism 4200. The interface orifice 4530 may, for example, correspond to a slot or hole through which a portion of the engagement member 4100 may be inserted. The interface orifice 4530 is sized to facilitate a desired degree of travel of the engagement member 4100.

Figure 13:
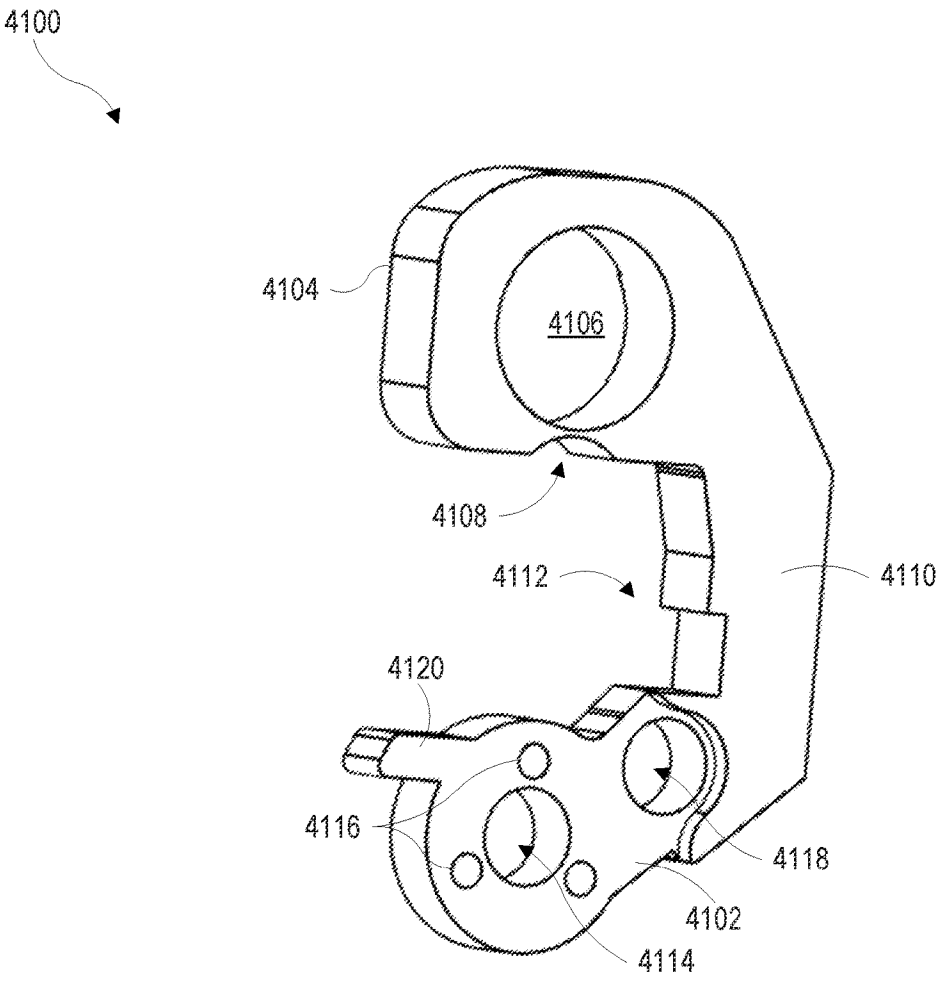
FIG. 13 is a perspective view of an embodiment of an engagement member of the safety system of FIGS. 8-12.

FIG. 13 is a perspective view of an embodiment of an engagement member 4100 for use with a safety system for a handgun 100 (FIG. 1), such as with the safety system 1000, the safety system 2000, and/or the safety system 4000. The engagement member 4100 is movably coupled to the handgun and includes the actuator portion 4102 and the contact face 4104. In other words, the engagement member 4100 may, in various embodiments, be configured to move/translate (e.g., slide, rotate, pivot, and/or tilt) relative to the frame of the handgun in accordance with the locked/unlocked configuration of the safety system. The movement/translation of the engagement member 4100 is the result of a motive force (e.g., motive force ($F_M$) (FIG. 11)) received by the actuator portion 4102 of the engagement member 4100. As such, in some embodiments, the actuator portion 4102 is operably coupled to receive the motive force from a motive assembly, such as the motive assembly 2400 or the motive assembly 4400.

The engagement member 4100 defines a muzzle orifice 4106 (e.g., an opening) that is aligned with a distal end (e.g., the muzzle) of the barrel of the handgun. The muzzle orifice 4106 is sized to circumscribe the muzzle of the handgun. In other words, the muzzle orifice 4106 has a diameter that is greater than an outer diameter of the handgun barrel at the muzzle. Accordingly, engagement member 4100 maintains a clearance with (e.g., does not obstruct) the muzzle of the handgun. Said another way, the muzzle orifice 4106 facilitates the departure of a projectile (e.g., a bullet) from the distal end of the barrel. Therefore, the handgun may be employed while the engagement member 4100 remains movably coupled thereto. In other words, in operation, a bullet departing the muzzle of the handgun passes through the muzzle orifice 4106 prior to continuing downrange.

In addition to the muzzle orifice 4106, the engagement member 4100 also defines a guide recess 4108. The guide recess 4108 establishes a clearance between the recoil spring guide of the handgun and the engagement member 4100. The guide recess 4108, therefore, facilitates a longitudinal movement of the engagement member 4100 by permitting a portion of the engagement member 4100 to pass between the barrel and the recoil spring guide of the handgun without contacting the recoil spring guide.

As shown, the portion of the engagement member 4100 defining the muzzle orifice 4106 and/or the guide recess 4108 is coupled to the actuator portion 4102 via a connection arm 4130. The connection arm 4130 transfers the motive force from the actuator portion 4102 the contact face 4104. In some embodiments, the connection arm 4130 defines a medial face profile 4112 (e.g., a profile in the face of the connection arm 4130 that is nearest a longitudinal midline of the safety system). The medial face profile 4112 is formed to conform with a portion of an outer face of a housing (e.g., the housing 1500, the housing 2500, and/or the housing 4500) of the safety system. By conforming with the portion of the outer face of the housing, the medial face profile 4112 may facilitate an unobstructed longitudinal movement of the engagement member 4100.

In some embodiments, the actuator portion 4102 is formed to facilitate the coupling of the engagement member 4100 to the motive assembly, such as the motive assembly 4400. Accordingly, the engagement member 4100 defines a lead screw opening 4114 configured to at least partially circumscribe a lead screw (e.g., the lead screw 4440), or other similar structure, of the motive assembly. Additionally, the engagement member 4100 defines a plurality of fasteners locations 4116 (e.g., through holes, threaded holes/inserts, and/or pins) for coupling the actuator portion 4102 to a drive nut (e.g., drive nut 4450) of the motive assembly.

In order to counter the torque of the motive assembly, in some embodiments, the engagement member 4100 defines a guideway opening 4118. The guideway opening 4118 is sized to receive a guide rail (e.g., the guide shaft 4460) of the motive assembly. In some embodiments, the guideway opening 4118 is sized to receive a linear bearing configured to move slidingly along the guide rail. Additionally, the engagement member 4100 defines a stop protrusion 4120 the stop protrusion is configured to engage a portion of the safety system, such as a portion of the housing and/or a portion of the motive assembly, to counter the torque generated by the motive assembly. In some embodiments, the lead screw opening 4114 may be positioned laterally between the stop protrusion 4120 and the guideway opening 4118.

Figure 15:
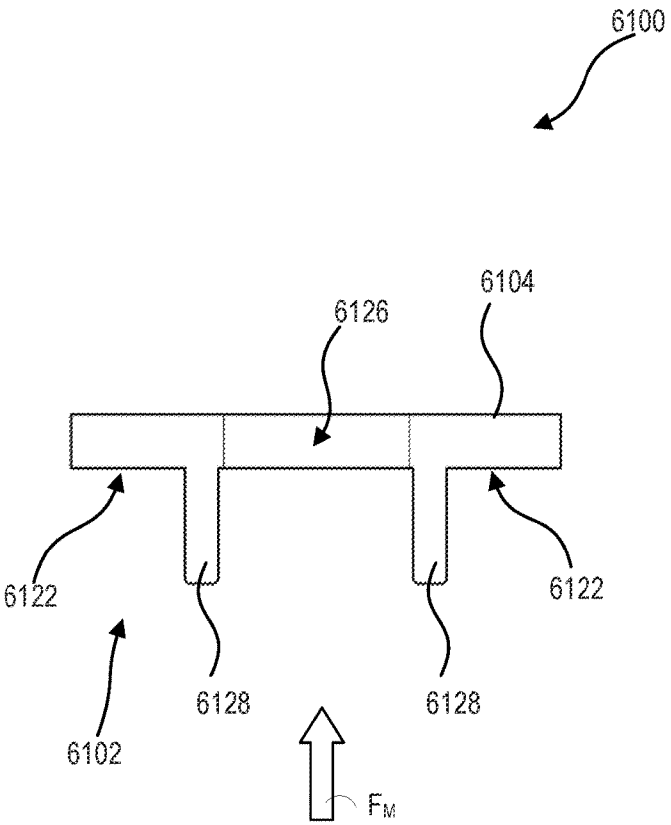
FIG. 15 is a top view of the engagement member of the safety system shown in FIG. 14.
Figure 14:
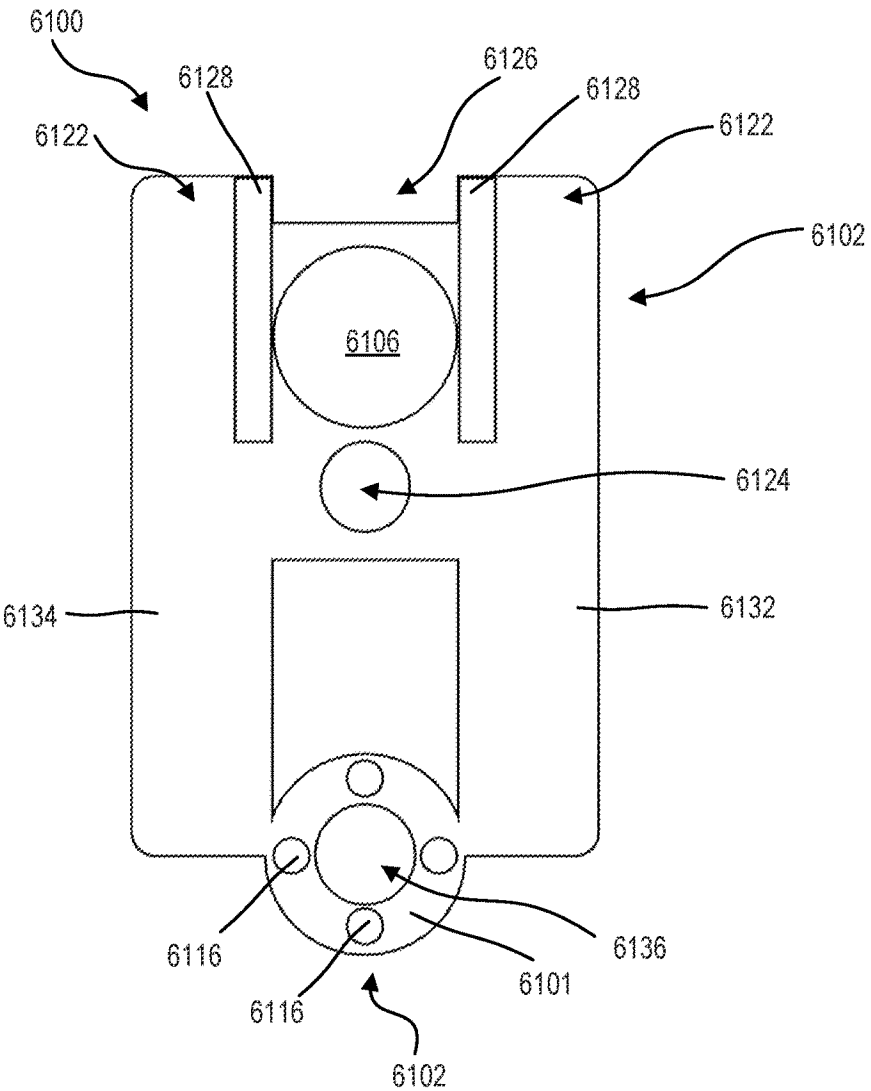
FIG. 14 is a front view of an embodiment of an engagement member of the safety system.

FIGS. 14 and 15 are a front view and a top view respectively of an embodiment of an engagement member 6100 of the safety system for use with a safety system for a handgun 100 (FIG. 1), such as with the safety system 1000, the safety system 2000, and/or the safety system 4000. The engagement member 6100 is arranged orthogonal to the longitudinal axis of the handgun and is movably coupled to the handgun. The engagement member 6100 includes a coupling portion 6101, at least one actuator portion 6102, and a contact face 6104. In other words, the engagement member 6100 may, in various embodiments, be configured to move/translate relative to the frame of the handgun in accordance with the locked/unlocked configuration of the safety system. The movement/translation of the engagement member 6100 is the result of a motive force motive force ($F_M$) received by the actuator portion(s) 6102 of the engagement member 6100. For example, in some embodiments the actuator portion(s) 6102 can include at least one grip portion 6122 that allows a user to manually grasp or manipulate the engagement member 6100 to move the engagement member 6100 relative to the frame. In other embodiments, the actuator portion(s) 6102 is operably coupled to receive the motive force from a motive assembly, similar to the motive assembly 2400 or the motive assembly 4400.

The engagement member 6100 defines a muzzle orifice 6106 (e.g., an opening) that is aligned with a distal end (e.g., the muzzle) of the barrel of the handgun. The muzzle orifice 6106 is sized to circumscribe the muzzle of the handgun. In other words, the muzzle orifice 6106 has a diameter that is greater than an outer diameter of the handgun barrel at the muzzle. Accordingly, engagement member 6100 maintains a clearance with (e.g., does not obstruct) the muzzle of the handgun. Said another way, the muzzle orifice 6106 facilitates the departure of a projectile (e.g., a bullet) from the distal end of the barrel. Therefore, the handgun may be employed while the engagement member 6100 remains movably coupled thereto. In other words, in operation, a bullet departing the muzzle of the handgun passes through the muzzle orifice 6106 prior to continuing downrange.

In addition to the muzzle orifice 6106, the engagement member 6100, also defines a guide opening 6124. The guide opening 6124 establishes a clearance between the recoil spring guide of the handgun and the engagement member 6100. The guide opening 6124, therefore, facilitates a longitudinal movement of the engagement member 6100 by permitting a portion of the engagement member 6100 to pass between the barrel and the recoil spring guide of the handgun without contacting the recoil spring guide.

In some embodiments, the engagement member 6100 defines a sighting recess 6126. The sighting recess 6126 is in visual alignment with the sights of the handgun. As such, the sighting recess 6126 may facilitate the alignment of the handgun with a target while the engagement member 6100 remains movably coupled to the handgun. Said another way, the As depicted in FIGS. 14 and 15, in some embodiments, the engagement member 6100 includes at least one placement guide 6128. The placement guide(s) 6128 is positioned to guide the placement of the finger(s) of the operator of the handgun when manually applying the motive force ($F_M$) to the engagement member 6100. The placement guide(s) 6128 guide/direct the finger(s) of the operator to the grip portion(s) 6122. The placement guide(s) 6128 also forms a barrier that restricts the placement of the finger(s) in front of the muzzle. In other words, the placement guide(s) 6128 limits the potential for a portion of the hand of the operator to be placed in the potential flightpath of a discharged projectile.

As shown, the portion of the engagement member 6100 defining the muzzle orifice 6106 and/or the guide recess 6108 is coupled to the coupling portion 6101 via a first connection arm 6132 and a second connection arm 6134. The first and second connection arms 6132, 6134 may transfer the motive force from the coupling portion, when configured as the actuator portion 6102, to the contact face 6104. In some embodiments, the coupling portion 6101 may be positioned between the first and second connection arms 6132, 6134.

In some embodiments, the coupling portion 6101 is formed to facilitate the coupling of the engagement member 6100 to the motive assembly, such as the motive assembly 4400. Accordingly, the engagement member 6100 defines a coupling orifice 6136 configured to at least partially circumscribe a lead screw similar to lead screw 4440, or other similar structure, of the motive assembly. Additionally, the engagement member 6100 defines a plurality of fasteners locations 6116 (e.g., through holes, threaded holes/inserts, and/or pins) for coupling the actuator portion 6102 to a drive nut (e.g., similar drive nut 4450) of the motive assembly. However, in some embodiments, the coupling portion 6101 is formed to receive a guide rail (e.g., similar to guide shaft 4460) via the coupling orifice 6136. In such an embodiment, the coupling orifice 6136 is sized to receive a linear bearing configured to move slidingly along the guide rail.

Figure 16:
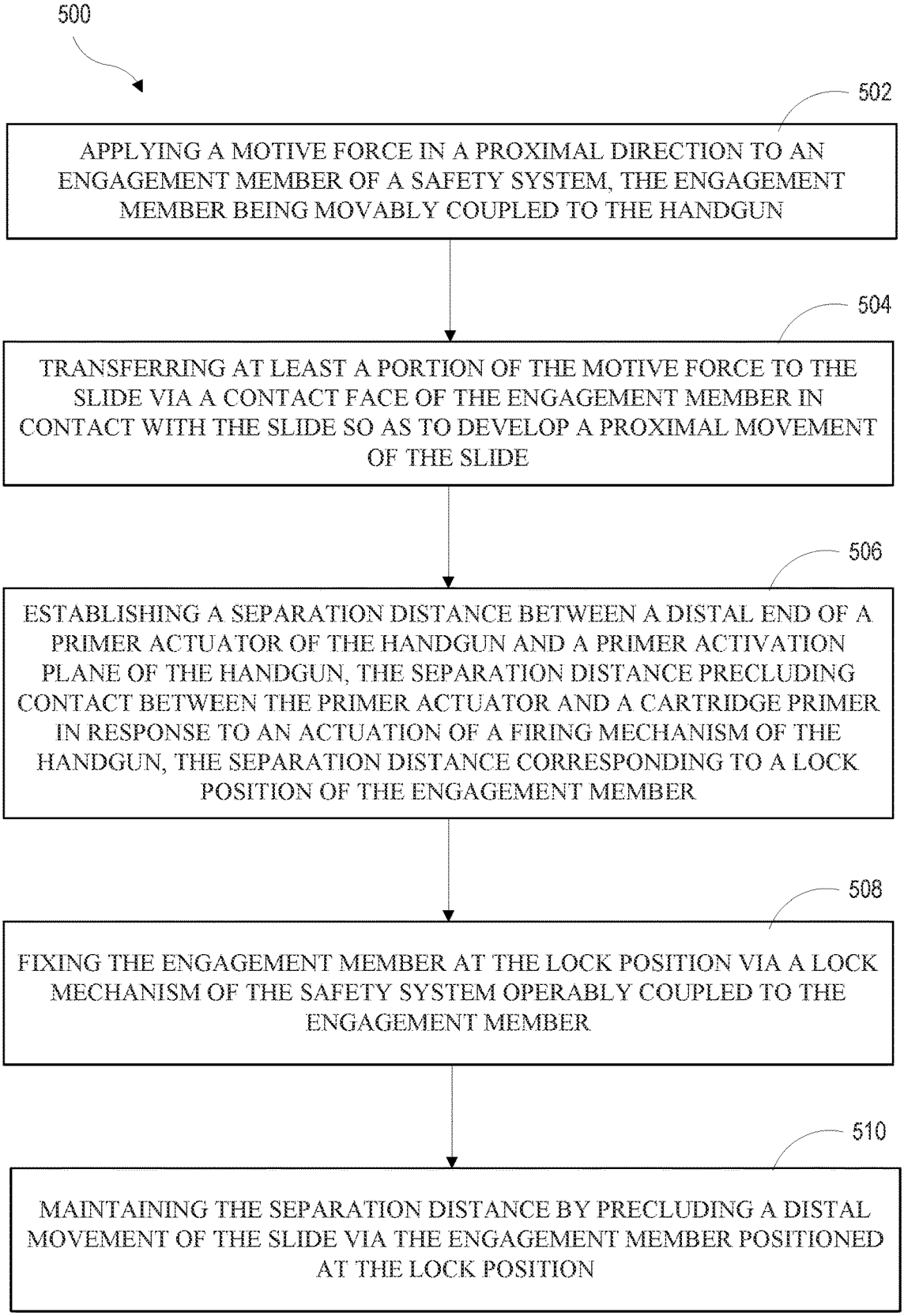
FIG. 16 is a flow chart of a method to make safe a handgun, according to an embodiment.

FIG. 16 is a flow chart of a method 500 for making safe a handgun according to an embodiment. The method 500 may, in an embodiment, be performed via a safety system, such as safety system 1000, safety system 2000, safety system 3000, and safety system 4000 as described with reference to FIGS. 3-12. However, it should be appreciated that in various embodiments, aspects of the method 500 may be accomplished via additional embodiments of the safety system or components thereof, such as engagement member 5100 and engagement member 6100 as described herein. Accordingly, the method 500 may be implemented on any suitable device as described herein. Those of ordinary skill in the art, using the disclosures provided herein, will understand that various steps of the method 500 or any of the other methods disclosed herein may be adapted, modified, rearranged, performed simultaneously, or modified in various ways without deviating from the scope of the present disclosure.

As shown at (502), the method 500 includes applying a motive force in a proximal direction to an engagement member of the safety system, with the engagement member being movably coupled to the handgun. As shown at (504), the method 500 includes transferring at least a portion of the motive force to the slide via a contact face of the engagement member. The contact face of the engagement member is in contact with the slide so as to develop a proximal movement of the slide. As shown at (506), the method 500 includes establishing a separation distance between a distal end of a primer actuator of the handgun and a primer activation plane of the handgun. The separation distance precludes contact between the primer actuator and a cartridge primer in response to an actuation of a firing mechanism of the handgun. The separation distance corresponds to a lock position of the engagement member. As shown at (508), the method 500 includes fixing the engagement member at the lock position via a lock mechanism of the safety system that is operably coupled to the engagement member. Said another way, the method 500 includes limiting movement of the engagement member via the lock mechanism. Additionally, as shown at (510), the method 500 includes maintaining the separation distance by precluding a distal movement of the slide via the engagement member positioned at the lock position.

In some embodiments, the method 500 includes ejecting a cartridge from a chamber of a barrel of the handgun in response to the proximal movement of the slide. In some embodiments, the motive force that develops the proximal movement of the slide is manually applied to the engagement member via an interface between an operator of the handgun and an actuator portion of the engagement member. However, in some embodiments, the method 500 includes applying the motive force to an actuator portion of the engagement member via a motive assembly.

In some embodiments, the method 500 includes maintaining the engagement member in the unlock position until a lock command is received via a user input of the safety system. In other words, the engagement member remains stationary in either the lock position or the unlock position until a transition is commanded via the user input. As such, once the safety system is placed in an unlocked configuration, the handgun remains operational until the safety system is affirmatively locked by the user. For example, once the safety system is placed in the unlocked configuration, the handgun may be discharged multiple times without necessitating further interaction (e.g., user authentication) with the safety system.

In some embodiments, after the fixing of the engagement member at the lock position, the method 500 includes unlocking the lock mechanism in response to a user input via a user interface of the safety system. In response to the unlocking of the lock mechanism, the method 500 may also include transitioning the engagement member from the lock position to an unlock position. In such an embodiment, the transition to the unlock position allows a distal movement of the slide. Said another way, unlocking the lock mechanism releases the engagement member thereby permitting the slide to assume a default slide-forward position in response to a force exerted by the recoil spring of the handgun. In some embodiments, the method 500 includes maintaining the coupling of the engagement member to the handgun when the engagement member is in the lock position, the unlock position, and during a transition between the lock position and the unlock position. Additionally, in some embodiments, the method 500 includes seating a cartridge in a chamber of a barrel of the handgun in response to the distal movement of the slide following the unlocking of the lock mechanism. In other words, the distal movement of the slide seats a cartridge from the magazine of the handgun and chambers the cartridge. Chambering the cartridge places the handgun in an operational condition from which the handgun may be discharged. In some embodiments, an opening defined by the engagement member facilitates the departure of a projectile from the distal end of the barrel. As such, in some embodiments, the method 500 includes actuating a firing mechanism of the handgun to discharge the cartridge while maintaining the coupling of the engagement member to the handgun following the unlocking of the lock mechanism.

Figure 17:
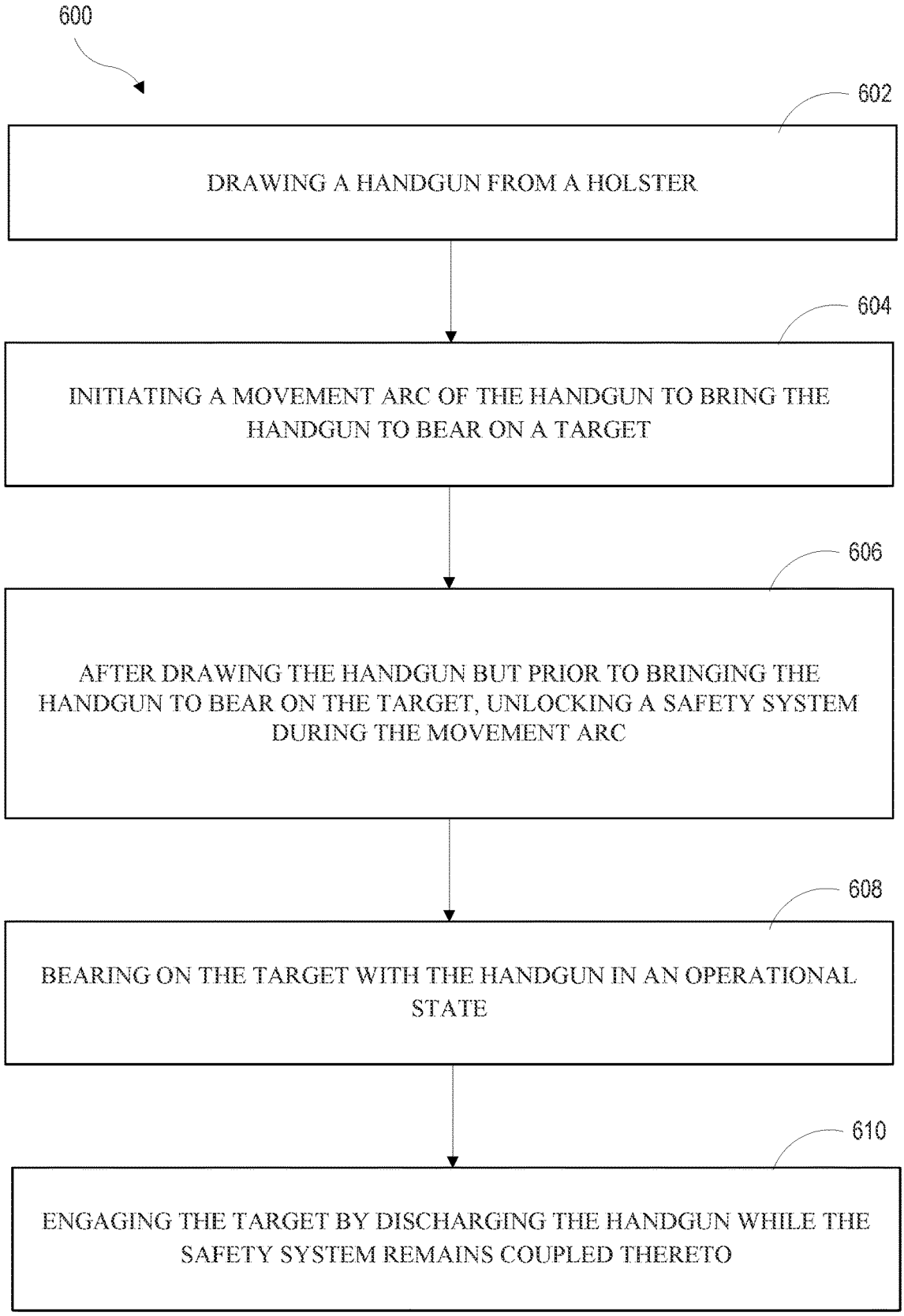
FIG. 17 is a flow chart of a method of target engagement via a handgun, according to an embodiment.

FIG. 17 is a flow chart of a method 600 for engaging a target via a handgun equipped with a safety system according to an embodiment. The method 600 may, in an embodiment, be performed via a safety system, such as safety system 1000, safety system 2000, safety system 3000, and safety system 4000 as described with reference to FIGS. 3-12. However, it should be appreciated that in various embodiments, aspects of the method 600 may be accomplished via additional embodiments of the safety system or components thereof, such as engagement member 6100 as described herein. Accordingly, the method 600 may be implemented on any suitable device as described herein. Those of ordinary skill in the art, using the disclosures provided herein, will understand that various steps of the method 500 or any of the other methods disclosed herein may be adapted, modified, rearranged, performed simultaneously, or modified in various ways without deviating from the scope of the present disclosure.

As shown at (602), the method 600 includes drawing a handgun from a holster. As shown at (604), the method 600 includes initiating a movement arc of the handgun to bring the handgun to bear on a target. After drawing the handgun but prior to bringing the handgun to bear on the target, the method 600 includes, as shown at (606), unlocking a safety system during the movement arc. The safety system being coupled to the handgun. As shown at (608), the method 600 includes bearing on the target with the handgun in an operational state. As shown at (610), the method includes engaging the target by discharging the handgun while the safety system remains coupled thereto. In other words, by unlocking the safety system during the movement arc the handgun is transitioned from a nonoperational state at the moment it is drawn from the holster to an operational state when it is brought to bear on the target. It should be appreciated that unlocking the safety system during the movement arc facilitates a more rapid target acquisition than may otherwise be possible with systems that require the unlocking of a holster, the removal of a locking apparatus, and/or the cycling of the handgun following the unlocking of the locking apparatus.

While various embodiments have been described above, it should be understood that they have been presented by way of example only, and not limitation. Where methods and/or schematics described above indicate certain events and/or flow patterns occurring in certain order, the ordering of certain events and/or operations may be modified. While the embodiments have been particularly shown and described, it will be understood that various changes in form and details may be made. For example, although the safety system 4000 is shown and described as including an electric motor to produce a motive force against the engagement member, in other embodiments, the safety system 4000 (and any of the safety systems described herein) can be devoid of a motive assembly. For example, in some embodiments the safety system 4000 can be manually manipulated by the user to move the engagement member.

As another example, although the although the safety system 4000 is shown and described as including a housing that is coupled to the handgun, in other embodiments, the safety system 4000 (and any of the safety systems described herein) can include a housing that is integrally formed with the frame of the handgun.

Although various embodiments have been described as having particular features and/or combinations of components, other embodiments are possible having a combination of any features and/or components from any of embodiments as discussed above. For example, any of the safety systems described herein can include any of the energy storage members or motive assemblies of any of the other safety systems described herein (e.g., the motive assembly 4400). As another example, any of the safety systems described herein can include any of the engagement members described herein (e.g., engagement member 3100, engagement member 4100, engagement member 5100, or engagement member 6100).

What is claimed is:

1. A safety system for a firearm, the safety system comprising:

an engagement member movably coupled to a frame of the firearm, the engagement member configured to move relative to the frame between a lock position and an unlock position, the lock position corresponding to a separation distance between a distal end of a primer actuator of the firearm and a primer activation plane of the firearm, the unlock position corresponding to a nominal position of the distal end of the primer actuator, the engagement member being configured to transition between the lock position and the unlock position while remaining movably coupled to the firearm, the engagement member including a contact portion configured to contact a movable component of the firearm in the lock position and maintain the separation distance;

a lock mechanism operably coupled to the engagement member and positioned to restrict a movement of the engagement member from the lock position while the lock mechanism is in an engaged state; and a user interface operably coupled to the lock mechanism and configured to transition the lock mechanism between the engaged state and a disengaged state.

2. The safety system of claim 1, wherein the movement of the engagement member between the lock position and the unlock position is a pivoting movement.

3. The safety system of claim 1, wherein the engagement member is configured to move from the unlock position to the lock position is in response to a manual motive force.

4. The safety system of claim 3, wherein:

the engagement member includes an actuator portion; and the actuator portion is configured to receive the manual motive force from a user of the firearm.

5. The safety system of claim 1, wherein the movement of the engagement member from the lock position to the unlock position is in response to a motive force generated by a spring.

6. The safety system of claim 1, wherein:

the firearm is a handgun;

the handgun includes a slide; and the engagement member is in contact with an outer surface of a distal portion of the slide on a condition that the engagement member is in the lock position.

7. The safety system of claim 6, wherein:

the slide is in a fully-retracted position on a condition that the engagement member is in the lock position; and the transition of the lock mechanism to the disengaged state facilitates a distal movement of the slide that chambers a cartridge to place the handgun in an operational condition.

8. The safety system of claim 1, wherein the transition of the engagement member to the lock position establishes a forced malfunction of the firearm.

9. The safety system of claim 1, further comprising:

a housing supporting the user interface, the housing including:

a coupling portion configured to receive a mounting structure of the firearm, a lock cavity defined by an inner face of the housing, the lock cavity supporting at least a portion of the lock mechanism, and an interface orifice to facilitate the operable coupling of the engagement member to the lock mechanism.

10. The safety system of claim 9, further comprising:

at least one fastener to secure the mounting structure of the firearm within the coupling portion, the at least one fastener being at least partially occluded by the engagement member when in the lock position thereby precluding access to the at least one fastener.

11. The safety system of claim 1, wherein the user interface includes at least one of a fingerprint reader, a radio frequency identification reader, a numerical input apparatus, a microphone, a magnetic key, or a mechanical key.

12. A method of handling a firearm with a safety system, the firearm including a movable component and a frame, the safety system being fixedly coupled to the frame and including a lock mechanism operably coupled to an engagement member, and a user interface operably coupled to the lock mechanism, the method comprising:

moving the movable component of the firearm in a proximal direction relative to the frame of the firearm; and moving the engagement member from an unlock position to a lock position, the engagement member having a contact portion that is in contact with the movable component of the firearm on a condition that the engagement member is in the lock position, movement of the engagement member from the lock position being restricted by the lock mechanism when the lock mechanism is in an engaged state, a separation distance between a distal end of a primer actuator of the firearm and a primer activation plane of the firearm being maintained by the engagement member when the engagement member is in the lock position, the separation distance precluding contact between the primer actuator and a cartridge primer in response to an actuation of a firing mechanism of the firearm.

13. The method of claim 12, further comprising:

providing a user input via the user interface, following the maintaining of the separation distance, the user input causing the lock mechanism to transition to a disengaged state;

the engagement member moving, in response to the transition of the lock mechanism to the disengaged state, from the lock position to the unlock position;

moving the movable component of the firearm in a distal direction relative to the frame; and actuating a firing mechanism of the firearm to discharge a cartridge while the safety system remains coupled to the firearm.

14. The method of claim 13, further comprising:

seating a cartridge in a chamber of a barrel of the firearm in response to the movement in the distal direction of the movable component following the disengagement of the lock mechanism.

15. The method of claim 13, wherein the engagement member remains coupled to the firearm when the engagement member is in the lock position, the unlock position, and during a transition between the lock position and the unlock position.

16. The method of claim 12, wherein the movement of the engagement member between the unlock position and the lock position is a pivoting movement.

17. The method of claim 12, wherein the moving of the engagement member from the unlock position to the lock position is in response to a manual motive force.

18. The method of claim 12, wherein the movement of the engagement member from the lock position to the unlock position is in response to a motive force generated by a spring.

19. The method of claim 12, wherein:

the firearm is a handgun;

the movable component of the firearm is a slide of the handgun; and the engagement member is in contact with an outer surface of a distal portion of the slide on a condition that the engagement member is in the lock position.

20. The method of claim 19, further comprising:

actuating, after rotating the engagement member from the unlock position to the lock position, a slide release of the handgun to bring the distal portion of the slide into contact with the contact portion of the engagement member in the lock position.

* * * * *